US011229820B2

(12) United States Patent
Kimura

(10) Patent No.: US 11,229,820 B2
(45) Date of Patent: Jan. 25, 2022

(54) WEIGHT LIFTING EQUIPMENT AND METHODS

(71) Applicant: Kris Kimura, La Habra, CA (US)

(72) Inventor: Kris Kimura, La Habra, CA (US)

( * ) Notice: Subject to any disclaimer, the term of this patent is extended or adjusted under 35 U.S.C. 154(b) by 87 days.

(21) Appl. No.: 16/659,211

(22) Filed: Oct. 21, 2019

(65) Prior Publication Data

US 2020/0114192 A1 Apr. 16, 2020

Related U.S. Application Data

(63) Continuation of application No. 15/599,347, filed on May 18, 2017, now Pat. No. 10,507,352, which is a continuation of application No. 14/459,598, filed on Aug. 14, 2014, now Pat. No. 9,682,275.

(60) Provisional application No. 62/011,896, filed on Jun. 13, 2014, provisional application No. 61/866,402, filed on Aug. 15, 2013.

(51) Int. Cl.

| | |
|---|---|
| ***A63B 21/078*** | (2006.01) |
| ***A63B 21/072*** | (2006.01) |
| ***A63B 71/00*** | (2006.01) |
| ***A63B 17/00*** | (2006.01) |
| *A63B 71/02* | (2006.01) |

(52) U.S. Cl.

CPC ..... *A63B 21/078* (2013.01); *A63B 17/00* (2013.01); *A63B 21/072* (2013.01); *A63B 21/0783* (2015.10); *A63B 71/0036* (2013.01); *A63B 2071/025* (2013.01); *A63B 2220/13* (2013.01); *A63B 2225/093* (2013.01)

(58) Field of Classification Search

CPC ..... A63B 21/078; A63B 21/0783; A63B 21/06–08

See application file for complete search history.

(56) References Cited

U.S. PATENT DOCUMENTS

| | | | | |
|---|---|---|---|---|
| 804,481 A | | 11/1905 | Lawrence | |
| 1,313,018 A | | 8/1919 | Rushton | |
| 1,999,106 A | * | 4/1935 | Muller | B60B 33/06 16/34 |
| 2,207,892 A | * | 7/1940 | Mullaney | B25B 1/06 59/1 |
| 4,154,173 A | * | 5/1979 | Chesnut | A47B 27/00 108/6 |
| 4,205,838 A | * | 6/1980 | McIntosh | A63B 21/078 482/104 |

(Continued)

OTHER PUBLICATIONS

Pendlay Elite Jerk Blocks "https://www.youtube.com/watch?v=ejRbQUxP0es" Apr. 5, 2013 (Year: 2013).*

(Continued)

*Primary Examiner* — Nyca T Nguyen

(74) *Attorney, Agent, or Firm* — Knobbe, Martens, Olson & Bear, LLP

(57) ABSTRACT

Various weight racks, plate racks, jerk blocks, and methods are disclosed. In some embodiments, the weight racks comprise one or more weight stands that can be connected and disconnected and that comprise rolling elements that allow free movement of the weight stands. In some embodiments, plate racks that allow weight plates to be rolled into and out of them are provided. In some embodiments, jerk blocks that are height adjustable without stacking are provided.

8 Claims, 36 Drawing Sheets

(56) References Cited

U.S. PATENT DOCUMENTS 4,368,884 A * 1/1983 Colvin ..... A63B 21/4029 482/104
4,529,198 A 7/1985 Hettick, Jr.
4,648,595 A * 3/1987 Selle ..... A63B 21/4029 482/104
4,799,673 A * 1/1989 Selle ..... A63B 21/078 482/104
4,822,034 A * 4/1989 Shields ..... A63B 21/0728 482/106
D317,031 S * 5/1991 Ceppo ..... D21/691
5,102,127 A 4/1992 Pohrer
5,108,089 A * 4/1992 Wilkinson ..... A63B 23/0458 108/12
5,127,647 A * 7/1992 Wilkinson ..... A63B 23/0458 108/12
5,141,480 A 8/1992 Lennox
5,178,444 A 1/1993 May et al.
5,306,220 A * 4/1994 Kearney ..... A63B 23/00 482/104
5,468,203 A * 11/1995 Okonkwo ..... A63B 21/078 248/125.2
5,547,087 A 8/1996 Licara
5,879,274 A 3/1999 Mattox
5,924,964 A * 7/1999 Hayden ..... A63B 21/4029 482/104
6,048,042 A 4/2000 Chan
D425,152 S 5/2000 Ceppo
6,149,556 A 11/2000 Jordan
D441,813 S * 5/2001 Ceppo ..... A63B 17/04 482/104
6,758,346 B2 7/2004 Kollegian
D495,381 S * 8/2004 Ceppo ..... A63B 23/047 D21/686
D495,382 S * 8/2004 Ceppo ..... F24F 13/32 D21/686
D504,164 S * 4/2005 Ceppo ..... A47B 96/06 D21/686
7,104,938 B1 9/2006 Smith
7,216,678 B2 8/2007 Crawford et al.
7,534,198 B1 * 5/2009 Strong ..... A63B 71/0036 482/94
7,674,208 B2 3/2010 Hoole
7,704,197 B2 4/2010 Yu
7,780,586 B2 * 8/2010 Gates ..... A63B 26/00 482/142
D755,909 S * 5/2016 James ..... A63B 21/00072 D21/686
9,327,161 B1 5/2016 Maher
9,555,309 B1 * 1/2017 LaBar ..... A63B 21/0724
2006/0063650 A1 3/2006 Francis
2008/0076641 A1 * 3/2008 Sheehan ..... A63B 21/078 482/92
2010/0326329 A1 * 12/2010 Kiekhaefer ..... A47B 96/06 108/25
2012/0252643 A1 10/2012 Drechsler
2013/0264297 A1 10/2013 Long
2014/0080685 A1 * 3/2014 Butler ..... A63B 21/00072 482/102
2014/0128229 A1 * 5/2014 York ..... A63B 21/078 482/104
2014/0194266 A1 * 7/2014 Raiten ..... A63B 21/4011 482/142
2015/0090846 A1 * 4/2015 Crowley ..... F24F 13/32 248/188.5
2015/0157892 A1 * 6/2015 Johnson ..... A63B 23/047 482/94
2017/0120131 A1 * 5/2017 Hedberg ..... A63B 21/0724
2018/0353795 A1 * 12/2018 Ostmeyer ..... A63B 23/035

OTHER PUBLICATIONS

Rogue Metal Jerk Blocks "https://www.roguefitness.com/metal-jerk-blocks" Jul. 5, 2014 (Year: 2014).*

* cited by examiner

400

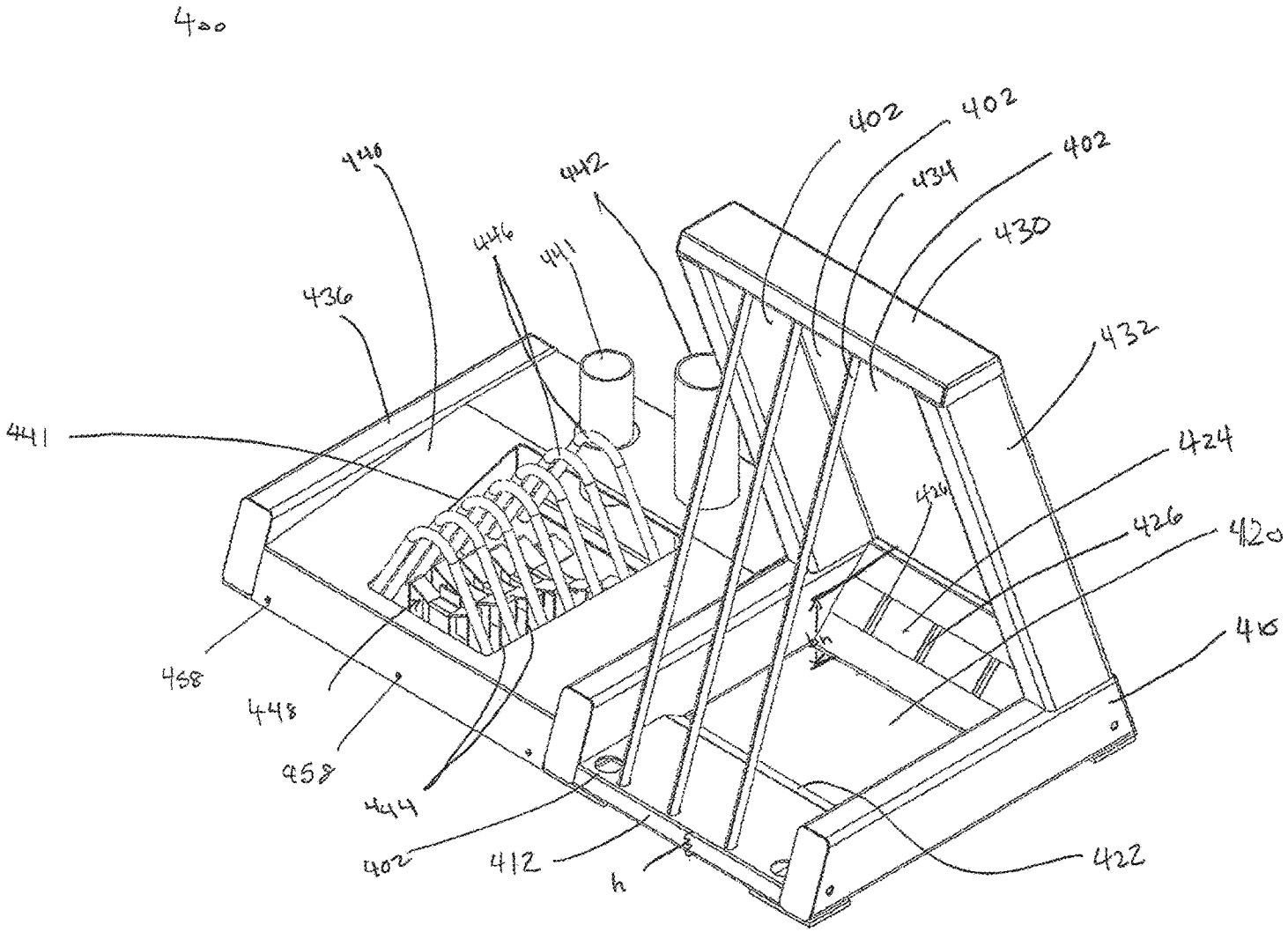
400
402
402
402

443

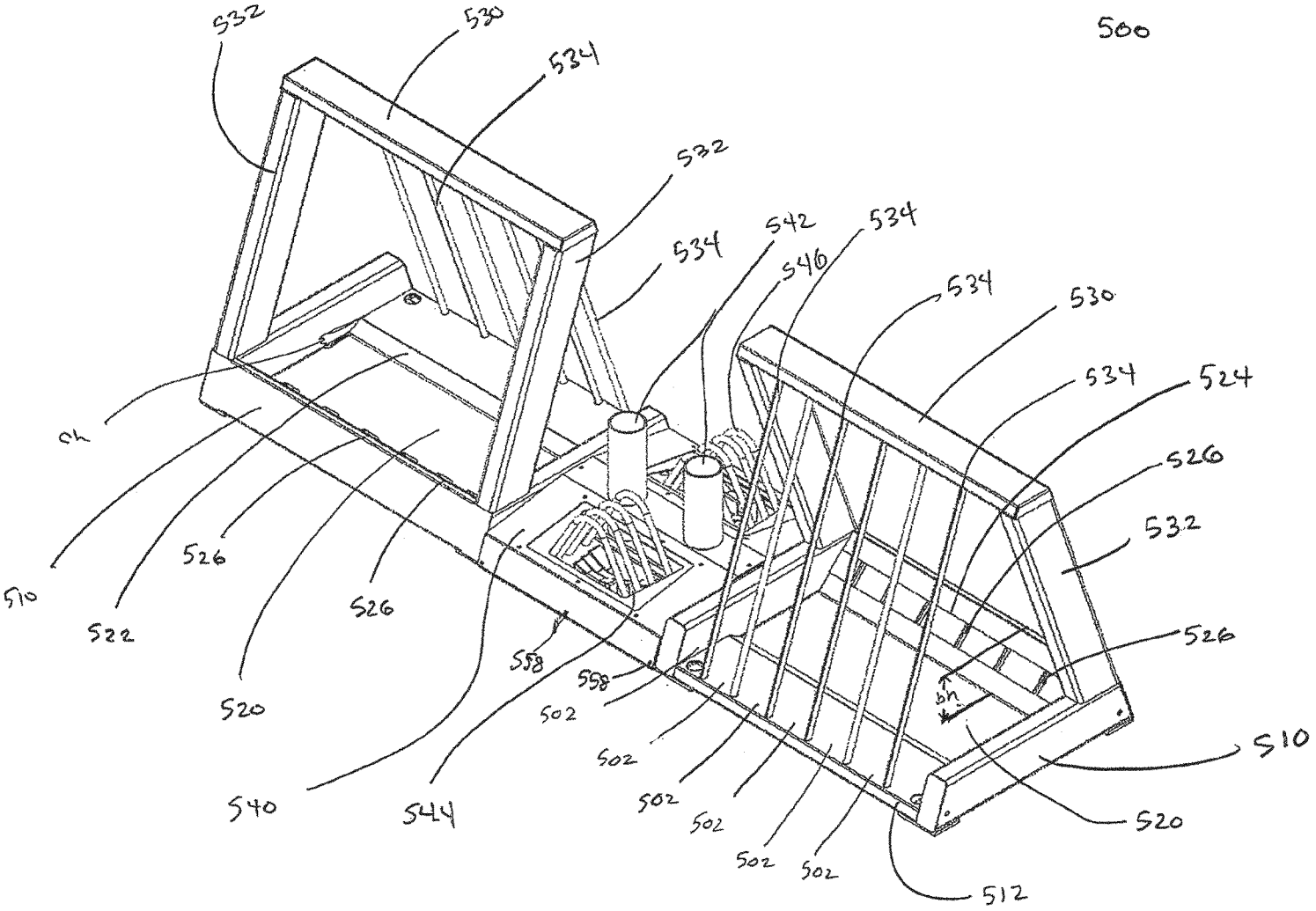
500
510
512
520
522
524
526
528
530
532
534
540
542
544
546
558
502
525
529
522
526
520
526
522
526
524
532
530
534
534
542
546
525
529
528
522
510
520
512
502
502
502
502
502
502
502
558
558
544
540
526
520
526
522
526
524
532
526
510
520
512

WEIGHT LIFTING EQUIPMENT AND METHODS

CROSS REFERENCE TO RELATED APPLICATIONS

This patent application is a continuation of U.S. patent application Ser. No. 15/599,347, filed May 18, 2017, which is a continuation of U.S. patent application Ser. No. 14/459,598, filed Aug. 14, 2014, which claims the benefit of priority to U.S. Provisional Patent Application No. 62/011,896, filed Jun. 13, 2014, and U.S. Provisional Patent Application No. 61/866,402, filed Aug. 15, 2013. All of the foregoing applications are fully incorporated herein by reference for all purposes.

BACKGROUND OF THE INVENTION

Field of the Invention

Disclosed herein are plate racks, weight racks, jerk blocks, and methods of making and use thereof.

Description of the Related Art

Barbell racks, plate racks, and jerk blocks are commonly employed in various exercise facilities and Olympic lifting facilities. A barbell rack (e.g. a squat rack) typically includes upright weights stands that support a barbell. Plate racks typically consist of upright frames having a protruding cylindrical weight support that passes through the barbell engaging portion of a plate or weight plate slots that receive plates after the plates are lifted off of the ground. Jerk blocks typically consist of large stackable, rectangular wooden frames that are stacked on one another to adjust height.

SUMMARY OF THE INVENTION

Some embodiments provide a barbell rack comprising a weight stand comprising a foot member configured to interact with a floor below the barbell rack, a stanchion extending upwardly from the foot member, a support member located on the stanchion and configured to secure and elevate a portion of a barbell above the floor, wherein when the weight stand is substantially upright a line drawn from the support member to the floor defines a vertical axis, and a rolling element connected to the foot member, wherein tilting the weight stand at an angle $\alpha$ away from the vertical axis towards the rolling element transfers a portion of a weight of the weight stand to the rolling element allowing movement of the weight stand across a portion of the floor via the rolling element.

In some embodiments the barbell rack further comprises a second weight stand. In some embodiments, the angle $\alpha$ ranges from about 10° to about 50°.

In some embodiments, the rolling element attaches to the foot member such that the rolling element does not contact the floor when the weight stand is upright. In some embodiments, the at least one rolling element further comprises a fender. In some embodiments, the fender further comprises stabilizing unit configured to provide upward support and to prevent bending of the fender when a weight is dropped on the fender. In some embodiments, the rolling element comprises at least one wheel. In some embodiments, the rolling element comprises a plurality of wheels. In some embodiments, the rolling element is composed of a material selected from the group consisting of plastic, composite, and rubber.

In some embodiments, the rolling element is configured to detach from the foot member.

In some embodiments, the stanchion comprises a sheath, a male extension member, and a securing member, the male extension member configured to reside at least partially in the sheath and configured to extend from the sheath to increase a height of the weight stand relative to the floor when the weight stand is upright, wherein the securing member is configured to engage the male extension member and the sheath to maintain the height of the weight stand.

In some embodiments, the securing member is configured to engage and insert through a sheath aperture on the sheath and an extension aperture on the male extension member. In some embodiments, the securing member comprises a grip. In some embodiments, the securing member comprises a spring-loaded pop pin, wherein the pop pin is spring loaded, wherein the pop pin attached to a housing located on the sheath, wherein the pop pin can be pulled out to allow movement of the male extension member upwardly and downwardly within the sheath, and wherein upon release of the pop pin the securing member is configured to engage male extension member via an extension aperture.

In some embodiments, the male extension member further comprises a plurality of extension apertures extending upwardly and configured to be engaged by the securing member. In some embodiments, each aperture in the plurality of apertures is about 2 inches apart.

In some embodiments, the weight stand further comprises a handle configured to facilitate tilting of the weight stand away from the vertical axis. In some embodiments, the handle is on a stanchion side opposite the securing member of the stanchion.

In some embodiments, the weight stand comprises a material selected from the group consisting of titanium, iron, steel, aluminum, nylon, high-density polyethylene, polypropylene, polystyrene and combinations thereof. In some embodiments, the weight stands comprise steel. In some embodiments, the weight stands comprise 7 gauge steel tubing. In some embodiments, the weight stands comprise 11 gauge steel tubing.

In some embodiments, the support member is c-shaped. In some embodiments, the support member comprises a protective cover. In some embodiments, the protective cover comprises a material selected from the group consisting of rubber, foam, polymer composite, high-impact resistant polyethylene, and combinations thereof.

In some embodiments, the stanchion comprises a second support member located below the support member and configured to catch the barbell if misplaced on the first support member.

In some embodiments, the weight rack further comprises a spacer having a width extending between the weight stands and a length extending substantially perpendicularly to the spacer width. In some embodiments, the spacer spans a distance between the first weight stand and the second weight stand the distance being appropriate to allow the support members of the weight stands to cooperatively support a barbell. In some embodiments, the spacer further comprises a locking mechanism configured to secure the weight stand. In some embodiments, the spacer further comprises a second locking mechanism configured to secure the second weight stand.

In some embodiments, the foot member further comprises an alignment aperture configured to allow the floor to be seen below the weight stand and configured to allow fine positioning of the weight stand.

Some embodiments involve a method of making a barbell rack, the method comprising providing a foot member, providing a support member configured to attach to the foot member, providing a rolling element configured to attach to the foot member, and providing a stanchion configured to connect the support member to the foot member.

Some embodiments provide a plate rack comprising a plate rack base configured to reside on a floor and a cradle portion, wherein the base is configured to allow a weight plate to roll into the cradle portion via the circumferential periphery of the weight plate, and wherein the cradle portion is configured hold the weight plate and to inhibit forward or backward rolling of the weight plate along the circumferential periphery of the weight plate.

In some embodiments, the base further comprises an external ramp configured to allow a weight plate to roll from the floor into the plate rack base and into the cradle portion. In some embodiments, the cradle further comprises an internal ramp configured to allow the first weight plate to roll out of the cradle portion. In some embodiments, the cradle further comprises a backstop to located on an opposite side of the plate rack base from the internal ramp and configured to prevent rolling of the weight plate passed the backstop. In some embodiments, the cradle further comprises an additional internal ramp on an opposite side of the plate rack base from the internal ramp and configured to allow rolling of the weight plate out of the cradle.

In some embodiments, the plate rack further comprises a stabilizing element configured to hold the weight plate in a position to allow rolling of the plate on its circumferential periphery.

In some embodiments, the plate rack further comprises a frame, the frame comprising a buttress member configured support a portion of the frame and to maintain the weight plate in the substantially vertical position. In some embodiments, the frame further comprises a divider configured to separate two weight plates resting in the plate rack.

In some embodiments, the plate rack further comprises a secondary housing. In some embodiments, the secondary housing comprises a weight disc housing configured to receive weight discs. In some embodiments, the secondary housing comprises a barbell holding element configured to hold a barbell in a substantially vertical position. In some embodiments, the secondary housing comprises a removable housing cover. In some embodiments, the secondary housing attaches to the plate rack via a housing locking mechanism, wherein the housing locking mechanism is configured to allow the base and the secondary housing to be separated.

Some embodiments provide an adjustable jerk block comprising a table top, a leg connected to the table top, wherein the leg is configured to hold the table top a distance from a floor, the leg comprising a leg sheath comprising a leg sheath aperture, a male leg extension member comprising male leg extension members aperture, and a securing member configured to engage the leg sheath and the male leg member to hold the table top at a preselected height, and wherein the jerk block further comprises a foot member connected to the leg and configured to provide traction between the jerk block and the floor.

In some embodiments, the jerk block securing member is affixed to the leg sheath and further comprises a spring-loaded pop-pin that automatically engages the leg sheath aperture and one of the male extension member apertures. In some embodiments, the leg sheath further comprises a handle positioned in proximity to the pop-pin such that a single hand from a user can simultaneously grasp the handle and release the pop-pin.

In some embodiments, the male extension member apertures are arranged substantially vertically along the male extension member. In some embodiments, the male extension members are arranged at a distance of 2 inches from one another.

In some embodiments, the jerk block further comprises a disengageable rolling element that allows free movement of the jerk block along the floor when in an engaged position and which does not allow free movement of the jerk block when in the disengaged position.

In some embodiments, the foot member further comprises an alignment aperture configured to allow a portion of the floor below the foot to be visible and to allow proper positioning of the jerk block on the floor.

In some embodiments, the jerk block further comprises a measuring tool deployable from the jerk block, wherein the measuring tool allows the distance between the jerk block and a second jerk block to be measured.

BRIEF DESCRIPTION OF THE DRAWINGS

These and other features, aspects and advantages are described below with reference to the drawings, which are intended to illustrate but not to limit the invention. In the drawings, like reference characters denote corresponding features consistently throughout similar embodiments.

FIG. 1B is a perspective view of an embodiment of a single weight stand.

FIGS. 1I-1K are perspective views of the back and side of an embodiments of weight stands.

FIGS. 2A-2H are perspective views of embodiments of a plate rack and components thereof.

FIGS. 2I-2K are perspective views of an embodiment of a weight disc holding portion.

FIGS. 2N-2O are perspective views of embodiments of plate racks.

FIGS. 2P-2Q are perspective views of embodiments of plate racks.

FIG. 3B is a perspective view of two jerk blocks.

DETAILED DESCRIPTION

A variety of embodiments and methods are described below to illustrate various examples that may be employed to achieve one or more desired improvements. These examples are only illustrative and not intended in any way to restrict the general inventions presented and the various aspects and features of these inventions. Furthermore, the phraseology and terminology used herein is for the purpose of description and should not be regarded as limiting. No features, structure, or step disclosed herein is essential or indispensible.

Weight Rack

Some embodiments provide a weight rack for supporting weights. In some embodiments, the weight rack is a barbell rack. Though the disclosure below pertains to embodiments of barbell racks, the weight rack can be used to support other, nonlimited devices for weightlifting and/or exercising (e.g. dumbbells, axles, etc.).

Figure 1A:
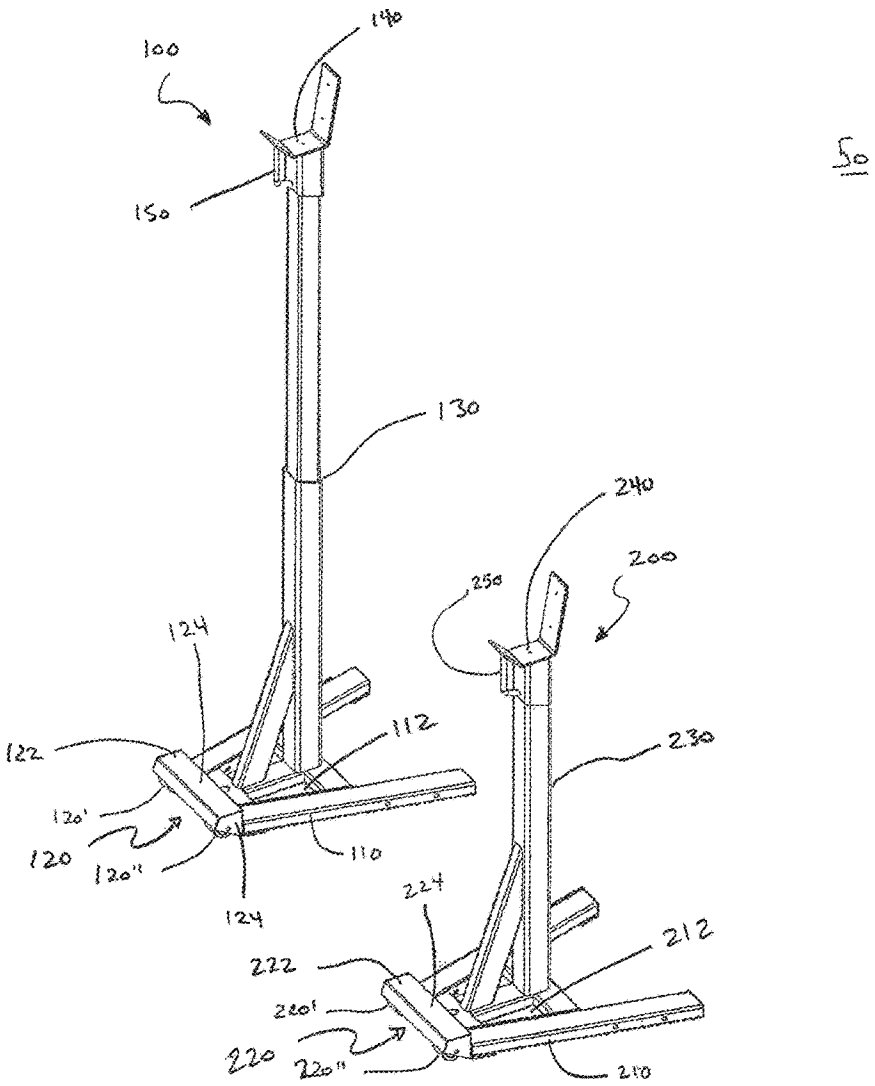
FIG. 1A is a perspective view of an embodiment of a weight rack.
Figure 13:
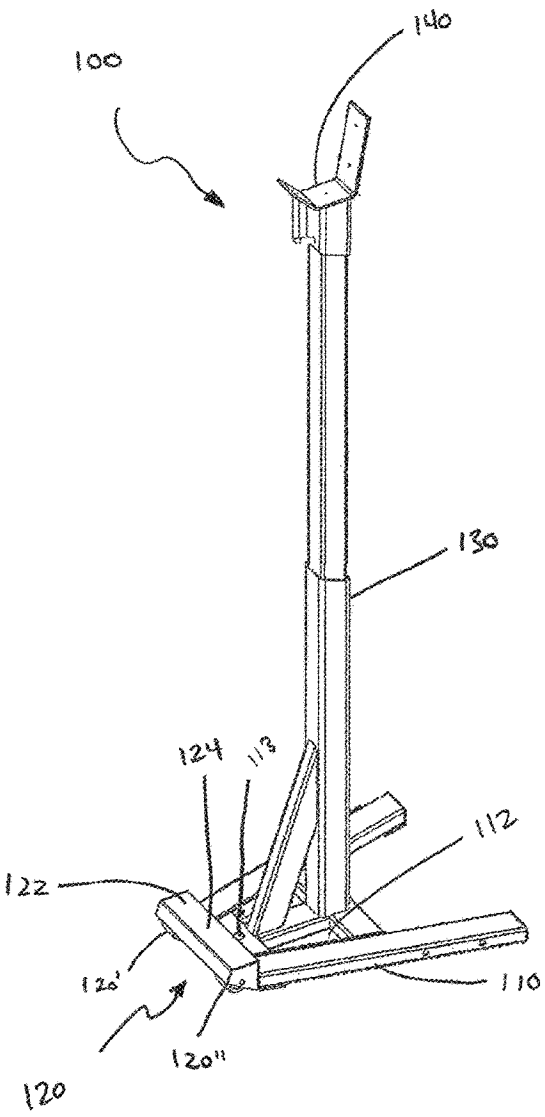

FIG. 1A illustrates an embodiment of a weight rack 50 (e.g., a barbell rack). In some embodiments, the weight rack 50 comprises at least a first weight stand 100. In some embodiments, the weight rack comprises a second weight stand 200. In some embodiments, the weight rack comprises additional weight stands.

When the weight rack 50 comprises more than one weight stand, the weight stands can be the same or different. For instance, each weight stand 100, 200 can have any one or more of the below features or combinations of features. Therefore, it should be appreciated that, while the below disclosure at times discusses a single weight stand (e.g. the first weight stand 100), in embodiments of the weight rack comprising multiple weight stands (e.g. a second weight stand 200), any one of the weight stands may have one or more of the following features. For instance, FIG. 1A illustrates both the first weight stand 100 and the second weight stand 200. The second weight stand 200 may be identical or similar to the first weight stand 100 discussed below in more detail in many respects. Accordingly, numerals used to identify features of the second weight stand 200 are incremented by a factor of 100 to identify like features of the first weight stand 100.

In some embodiments, as shown in FIG. 1B, the first weight stand 100 comprises a foot member 110 configured to contact a surface below the barbell rack, a stanchion 130 extending upwardly from the foot member 110, and a weight stand support member 140 engaged to (e.g. connected to) the stanchion 130 and configured to secure and elevate a portion of a barbell above the surface below the barbell rack.

In some embodiments, the first weight stand 100 has a front, a back, a first side (e.g. a right side), and a second side (e.g. a left side). In some embodiments, the front of the first weight lifting stand is configured to present and receive a portion of a weight (e.g. a barbell) to and from a weightlifter, respectively. For example, as a weightlifter removes a barbell from the first weight stand 100, the barbell is removed in the frontward direction of the weight stand. Likewise, as the weightlifter re-racks (i.e. places the weight back on the weight stand), the weightlifter approaches the first weight stand from the front.

In some embodiments, the foot member 110 extends horizontally (forwardly, backwardly, sideways, or combinations thereof) from a portion of the stanchion 130 (e.g. a lower portion of the stanchion) along a portion of the surface below the weight stand to form a base around the first weight stand 100, holding the weight stand in an upright or about upright position. The foot member 110 can comprise any suitable shape able to maintain the weight support in an upright position in relation to the surface below the first weight stand 100. For instance, in some embodiments, when viewed from above, the foot member 110 can forms a trapezoidal, triangular, diamond, rectangular, square, or circular shaped base of the weight stand 100. In some embodiments, as shown in FIG. 1B the foot member 110 may be A-shaped. In some embodiments, the foot member may be I-shaped, H-shaped, U-shaped, T-shaped, or any other shape keeping in mind the general purpose of the foot is to stabilize the weight stand in a position that is acceptable for receiving a barbell.

In some embodiments, as shown in FIGS. 1A and 1B, the foot member 110 comprises an alignment aperture 112 (e.g. an aperture or window) through the foot member which allows a portion of the platform below the foot member 110 to be visible when the weight stand is in position. This alignment aperture 112 can be used to assist a weightlifter in positioning the weight stand 100 on, for example, an Olympic lifting platform. For instance, because in some embodiments the first weight stand 100 and the second weight stand 200 are independently positionable on a weight lifting platform, improper positioning of the weight stands can leave the weight stands spaced too closely or too far apart to hold a barbell properly and safely. The alignment windows 112, 212 can be used to allow better positioning. The weight platform can be marked with position indicators such that when the alignment apertures of two weight stands are aligned with the weight stands' respective position indicators, the first weight stand and the second weight stand are at a proper distance from one another. In some embodiments, a plurality of alignment apertures can be used. In some embodiments, as shown in FIG. 1B, an alignment aperture 113 can be placed through a portion of the foot member 110.

The surface below the weight stand is not limited and comprises any surface suitable for supporting a weight stand and/or weight rack (e.g. a portion of ground, a floor, a platform, an Olympic weightlifting platform, and the like).

In some embodiments, as shown in FIG. 1B, the foot member 110 further comprises a rolling element 120 configured to allow movement of the weight stand. The rolling element 120 can be of any shape or size keeping in mind the general purpose of the rolling element 120 is to allow reduced friction against the surface below the first weight stand 100 during movement of the first weight stand 100 to facilitate movement. In some embodiments, this element can be a friction reducing element that does not require rolling (e.g. a Teflon surface or similar surface). In some embodiments, the rolling element 120 allows the first weight stand 100 to be moved freely upon the surface with minimal effort (or reduced effort relative to a stand without rolling elements) from the subject moving the first weight stand 100.

In some embodiments the rolling element 120 comprises a wheel. In some embodiments, the rolling element comprises one or more of a wheel, a spherical ball, an elongate cylindrical rolling pin, or any combination thereof. In some embodiments, the rolling element can be oriented along a side (e.g. to the front, back, left side, or right side) of the foot member 110 to allow movement of the first weight stand 100 via the rolling element 120 when the first weight stand 100 is tilted towards the rolling element 120.

Figure 1C:
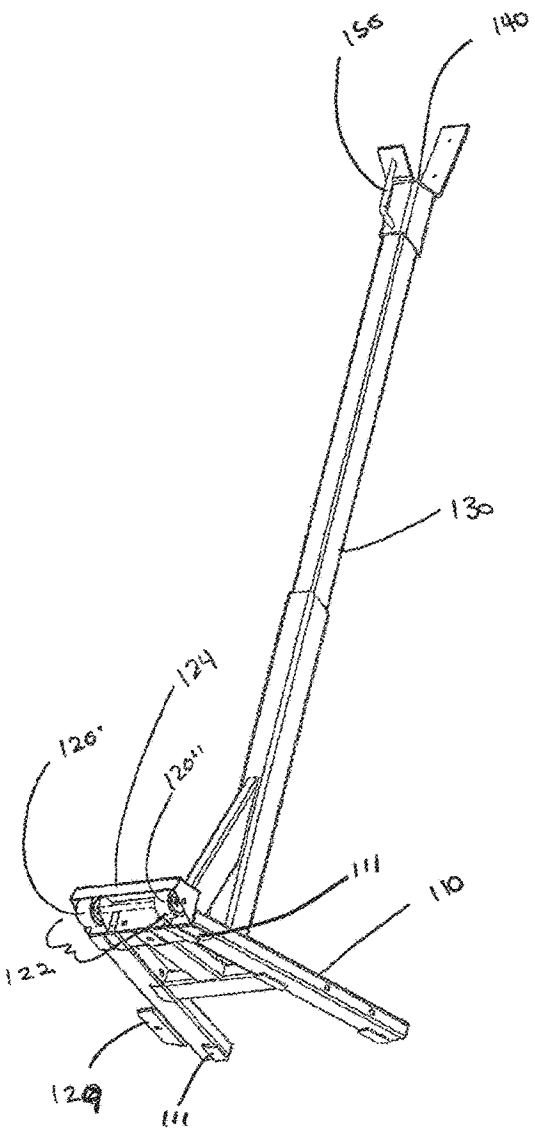
FIG. 1C is a perspective view from the bottom of an embodiment of a single weight stand.

In some embodiments, as shown in FIGS. 1A-1C, the foot member 110 may have a plurality of rolling elements 120', 120". For example, in some embodiments, the foot member comprises 1, 2, 3, 4, 5, 6, 7, 8, 9, 10, or more rolling elements. In some embodiments, as shown in FIG. 1C, when the foot member 110 comprises a plurality of rolling elements 120', 120" the rolling elements can be oriented on the foot member 110 so that they operate in unison (e.g. positioned in a row). For example, the foot member 110 can comprise a row of rolling elements comprising two rolling elements 120', 120" located toward the front of the foot member 110 as shown in FIG. 1C. In this configuration, when the first weight stand 100 is tilted an angle α from the vertical axis, and frontwards, the weight of the first weight stand 100 is distributed evenly on each rolling element 120', 120", allowing the first weight stand 100 to be easily moved along the floor via the rolling elements operating in unison.

Figure 1D:
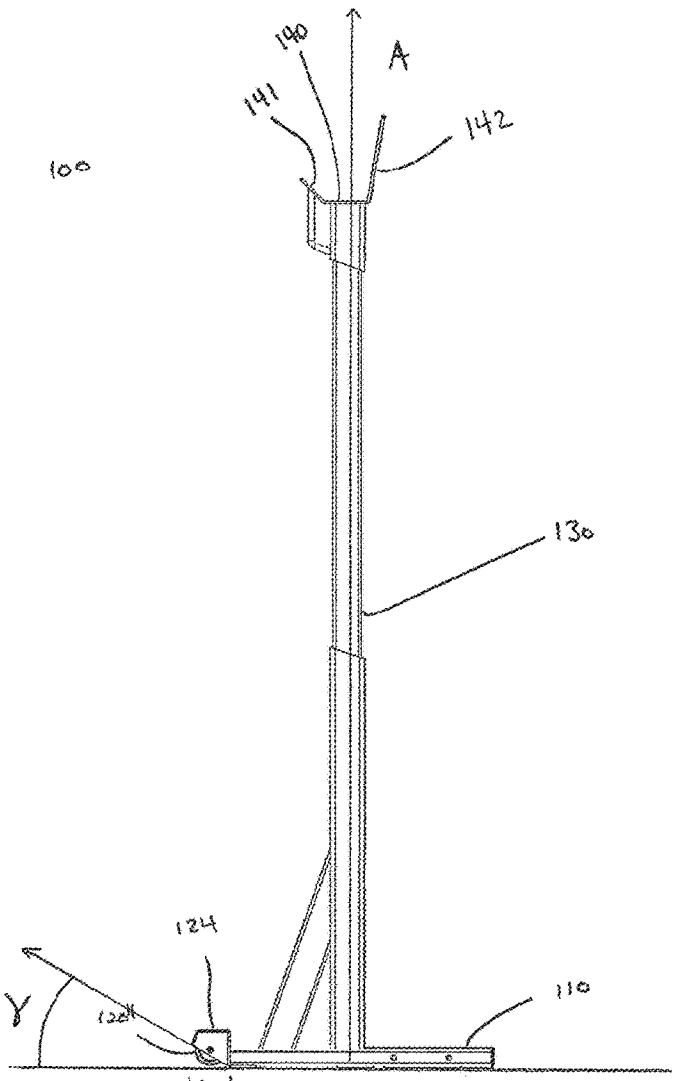
FIGS. 1D and 1E are side views of an embodiment of a single weight stand.
Figure 1E:
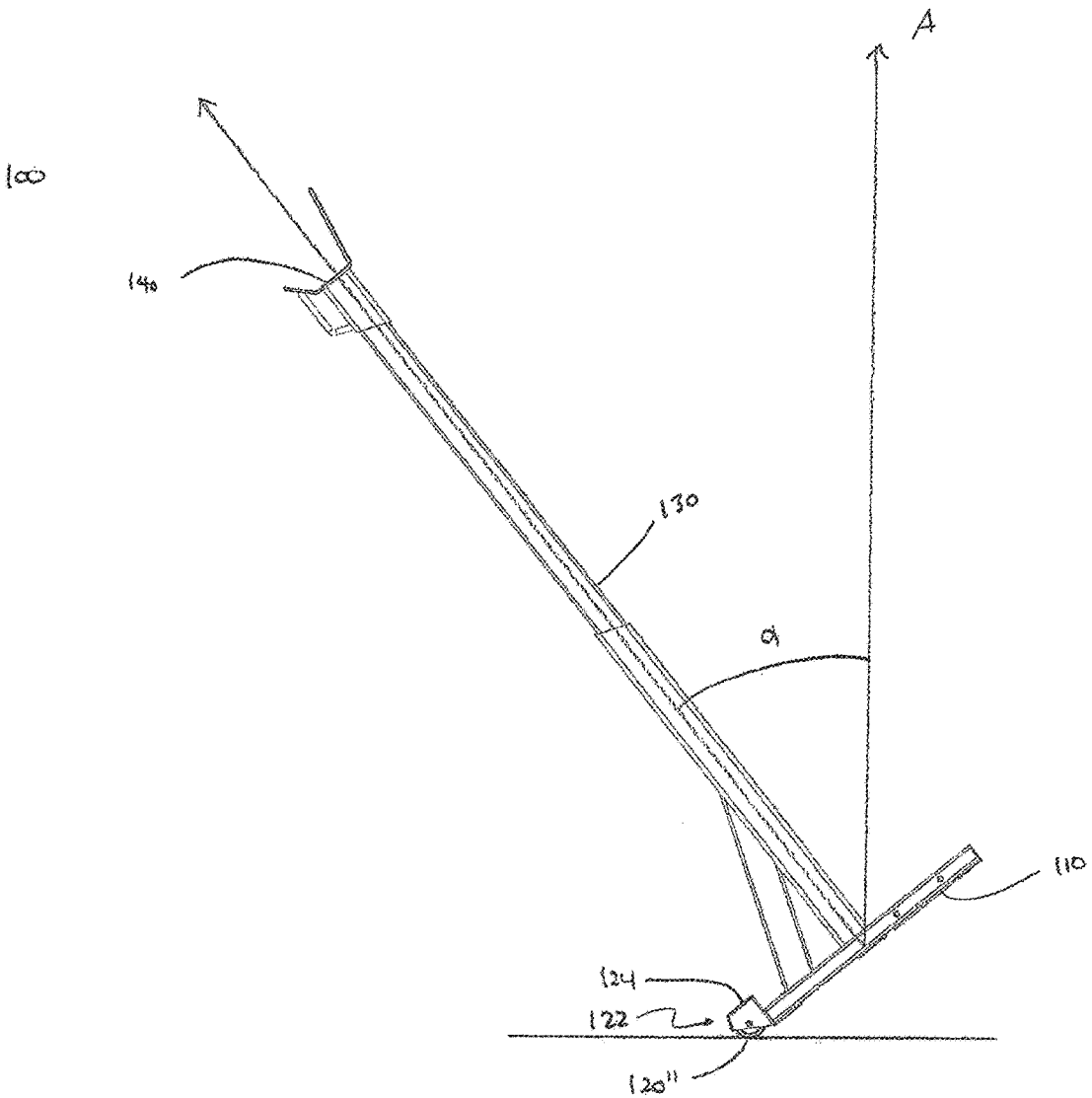

In some embodiments, as shown in FIG. 1D, the rolling element 120" or plurality of rolling elements are attached to the foot member 110 such that the rolling element 120" or plurality of rolling elements do not contact the floor when the first weight stand 100 is upright. For example, in some embodiments, the rolling element 120" is elevated above and does not contact the floor (as shown in FIG. 1D) until the support member is tilted away from the vertical axis A at an angle α (as shown in FIG. 1E). In some embodiments the rolling element is elevated off the floor (i.e. surface below the weight stand) by a distance ranging from about 0 mm to about 5 mm, about 5 mm to about 10 mm, about 10 mm to about 20 mm, about 20 mm to about 30 mm, about 30 mm to about 40 mm, about 40 mm to about 50 mm, or about 50 mm to about 100 mm. In some embodiments, when the weight stand is in the upright position, the rolling element is elevated above the floor by a distance of greater than 1 mm, 5 mm, 10 mm, 20 mm, 30 mm, 40 mm, 50 mm, 100 mm, values in between the aforementioned values, and otherwise. In some embodiments, at least a portion of the rolling element contacts the floor when the weight stand is upright.

In some embodiments, having an elevated rolling element 120" configuration, as shown in FIG. 1D, may confer additional stability and traction to the weight stand 100 by preventing the rolling element 120" from inadvertently rolling on the floor, for example, during re-racking of a barbell onto the weight stand 100. In some embodiments, at an angle α, the rolling element 120" contacts the floor and provides a pivot point, bearing a portion of the weight of the first weight stand 100. At an angle α, the rolling element 120 allows the first weight stand 100 to move (e.g. roll) via the rolling element 120 (which contacts the surface below the first weight stand 100) wherein the movement is with reduced friction relative to a weight rack lacking a rolling element 120. In some embodiments, the fender 124 is angled such that In some embodiments, at an angle α, the first weight stand 100 moves freely and easily on the floor via the rolling element 120. In some embodiments, angle α ranges from about 10° to about 60°. In some embodiments, angle α ranges from about 1° to about 10°, about 10° to about 20°, about 20° to about 30°, about 30° to about 40°, about 40° to about 50°, about 50° to about 60°, about 60° to about 70°, about 70° to about 80°, or about 80° to about 90°. In some embodiments, angle α ranges from about 1° to about 90°, about 10° to about 80°, about 20° to about 70°, about 30° to about 60°, or about 40° to about 50°. In some embodiments, the weight stand is able to move freely and easily on the surface via the rolling element when a is greater than about 10°, 20°, 30°, 40°, 50°, 60°, 70°, 80°, values in between the aforementioned values, and otherwise.

In some embodiments, the rolling elements 120', 120" are part of a rolling element module 122. In some embodiments, the rolling element module 122 comprises the is modular and configured to detach from and reattach to the foot member 110. This modular design facilitates replacing rolling elements 120 by replacement of the rolling element module 122 after wear or after damage from, for example, a dropping weight. In some embodiments, modular rolling element 122 attachment can be clipped, screwed, or otherwise secured in place on the foot member 110.

In some embodiments, as shown in FIGS. 1A-1F, the rolling element 120 is covered by a fender 124. In some embodiments, the rolling element module 122 comprises the rolling element 120 and fender 124.

Figure 1F:
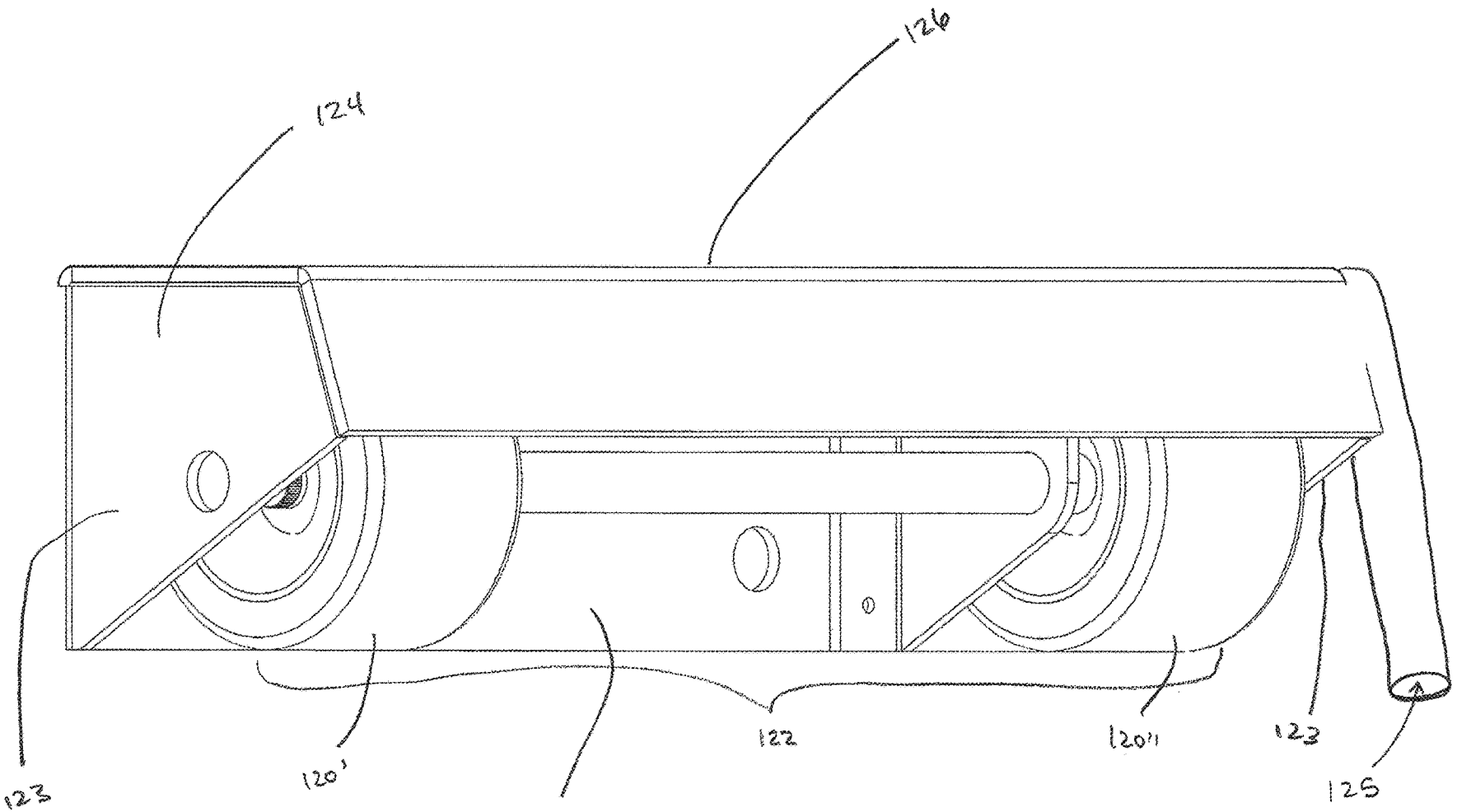
FIG. 1F is a perspective view of a module containing rolling elements.

In some embodiments, the fender 124 provides protection to the rolling elements 120 from, for example, dropping weights. In some embodiments, as shown in FIG. 1F, the fender 124 can have a flat upper surface 126 that extends laterally across the weight stand 100. In some embodiments, as shown in FIG. 1D, the flat upper surface 126 of the fender 124 also provides a stepping point (serving as a pivot point) so that the weight stand 100 can be easily tilted away from the vertical axis A to an angle α. For example, a user may step on the fender 124 while simultaneously pulling an upper portion of the stanchion 130 towards the user. This shifts the weight from the foot member 110 base to the rolling elements 120. The weight stand 100 can then be re-positioned as desired by the user. This stepping point reduces the effort needed by the user to tilt the weight stand 100, thus lessening any risk of injury to the user.

The fender 124 also allows the user to easily position the weight stand 100 in an appropriate area as the weight stand 100 is tilted back onto the foot member base 110. For instance, the user can plant his heel into the ground while a portion of the user's foot remains on the fender 124. The rolling elements 120 can then be used to turn and pivot the weight stand 100 into an appropriate position for storage or for lifting weights.

In some embodiments, as shown in FIG. 1F, the fender 124 comprises a front shield portion 127 that shields the rolling elements 120', 120". In some embodiments, also as shown in FIG. 1F, the fender further comprises a back securing portion 128 that can be used to connect the rolling elements module 122 to the foot member 110. In some embodiments, as shown in FIG. 1F the back securing portion 128 is longer (e.g., extends nearer to the floor) than the front shield portion 127. In some embodiments, as shown in FIG. 1D, the side fender portions 123 extend downward at an angle γ towards the floor and intersect with the back securing portion 128 of the fender 124.

In some embodiments, the angle γ can be selected to provide a range of angles α at which the weight stand 100 can be moved. For example, based on the angle γ of the side fender portions 123, tilting the weight stand too far will cause the front shield portion 127 to contact the ground. This angle γ provides a built in safety mechanism to avoid injury and to lower the likelihood of strain during the movement of the weight stand 100. For example, at certain angles α, the full weight of the weight stand 100 can be substantially distributed on the rolling element 120. When substantially all of the weight is born on the rolling element 120 at a preselected angle α, the user experiences the least amount of weight from the weight stand 100, and can move the weight stand 100 freely and with the lowest likelihood of strain. The angle γ can be selected to provide an angle α at which the maximum weight is experienced by the rolling element 120 and the least amount by the user.

In some embodiments, angle γ ranges from about 10° to about 60°. In some embodiments, angle γ ranges from about 1° to about 10°, about 10° to about 20°, about 20° to about 30°, about 30° to about 40°, about 40° to about 50°, or about 50° to about 60°. In some embodiments, angle γ ranges from about 1° to about 90°, about 10° to about 80°, about 20° to about 70°, about 30° to about 60°, or about 40° to about 50°.

In some embodiments, as shown in FIG. 1F, the fender has a kickstand member 125 (e.g., a deployable rod or similar support structure that can telescope or swing into place) that may be engaged when the weight stand is in the substantially upright position. When the weight stand 100 is configured to be moved, the kickstand member 125 may be disengaged. The kickstand member 125 can provide additional upward support for the fender 124 increasing the durability of the fender 124 or the entire rolling elements module 122. This upward support can prevent the fender 124 from being bent or deformed if a loaded barbell is dropped onto the fender 124. In some embodiments, the fender has a plurality of kickstand members. In some embodiments, the kickstand members can be located in or outside of the fender.

In addition to the row of rolling elements 120', 120" described above that work simultaneously, rolling elements oriented to operate separately are also envisioned. For instance, in some embodiments, the rolling elements (or pluralities or rows of rolling elements) may be located on opposite sides of a foot member (i.e. on the front side and the back side of a square foot member). When located on opposite sides of the foot member, the rolling elements can be used to move the weight stand when the weight stand is tilted frontwardly and/or backwardly (or to the sides). Of course, the rolling elements can also be configured at an angle relative to one another (e.g. a rolling element on the side and a rolling element on the front of the foot).

In some embodiments, multiple rows or fields of rolling elements may be located on one side of the foot member. For instance, a second row of rolling elements (row 2) could be oriented above and farther from the floor than a first row of rolling elements (row 1). In this configuration, the rows of rolling elements could be used separately or concurrently. For example, at some angle α', the floor may be in contact with only the row 1 rolling element. At an intermediate angle α" both rows could be in contact with the floor. Finally, at a third and greatest angle α"', only the row 2 elements could be in contact with the floor.

In some embodiments, the rolling element comprises a material such as rubber, plastic, metal, ceramic, composite, or combinations thereof. In some embodiments, the rolling element comprises polyurethane. In some embodiments, the rolling element comprises a material with a hardness on the shore durometer A scale of between 72 A-101 A. In some embodiments, the hardness on the durometer A scale is between about 72 A and 85 A, about 85 A and about 90 A, about 90 A and about 95 A, or about 95 A and about 101 A. In some embodiments, the hardness of the wheels is greater than about 72 A, 75 A, 80 A, 85 A, 90 A, 95 A, 100 A, or 101 A.

In some embodiments, each rolling element further comprises one or more ball bearings. Ball bearings allow the rolling element to rotate freely and smoothly. In some embodiments, the ball bearings comprise plastic, ceramic, metal, or combinations thereof. In some embodiments, the bearings have an ABEC rating of between 1 to 11. In some embodiments, the ABEC rating of the rolling elements is higher than 1, 3, 5, 6, 7, or 9. In some embodiments, the ball bearings comprise dirt proof or waterproof seals. In some embodiments, bushings are used to allow the rolling elements to move and rotate.

In some embodiments, the rolling elements can be of any suitable size to allow movement of the weight rack. In some embodiments, the rolling elements have a diameter between about 10 mm and about 20 mm, about 20 mm and about 30 mm, about 30 mm and about 40 mm, about 40 mm and about 50 mm, about 50 mm and about 60 mm, about 60 mm and about 70 mm, about 70 mm and about 80 mm, about 80 mm and about 90 mm, about 90 mm and about 100 mm, about 100 mm and about 110 mm, or about 110 mm and 120 mm. In some embodiments, the diameter of the rolling elements is at least about 10 mm, 20 mm, 30 mm, 50 mm, 60 mm, 70 mm, 80 mm, 90 mm, 100 mm, 110 mm, or 120 mm values in between the aforementioned values, and otherwise.

In some embodiments, as shown in FIG. 1C, the foot member 110 further comprises traction pads 111 that contact the floor when the weight stand is in the upright position. The traction pads 111 can be any size, shape, material, or configuration, keeping in mind their purpose is to increase the amount of friction between the weight stand and the floor (shown as rectangular pads in FIG. 1C). In some embodiments, the traction pads aid in stabilizing the weight stand and in preventing horizontal movement of the weight stand. In some embodiments, the traction pads also facilitate placement of the weight stand by gripping a portion of the floor as the stand is tilted from angle α to the upright position. In some embodiments, the traction pads are placed under the foot member and are configured to reside between the floor and the weight stand. In some embodiments, the traction pads comprise rubber, metal, plastic, composite, or any other material that prevents slippage of the weight stand. In some embodiments, the traction pads comprise surface topography such as knurling, scoring, pyramidal patterns, and the like to provide additional contact points to the floor.

In some embodiments, the foot member 110 further comprises a floor securing mechanism 129 as shown in FIG. 1C. This floor securing mechanism 129 can be bolted or otherwise fashions to the surface below the weight stand 100 for added stability.

In some embodiments, the weight stand further comprises a handle 150 configured to facilitate tilting of the weight stand 100 away from the vertical axis. In some embodiments, the handle 150 and the fender 124 both are on the same side of the weight stand 100 (e.g., the front of the weight stand as shown in FIGS. 1A-1G) to aid the user in tilting the weight stand 100 without strain. In some embodiments, the handle 150 contacts the support member 140. In some embodiments, the handle 150 is attached to the stanchion 130 at substantially at the top of the stanchion 130. In some embodiments, the handle 150 is located on the support member 140. In some embodiments, an upper portion of the handle 150 is affixed to the support member 140, while a lower portion of the handle 150 is affixed to the stanchion 130. By having the handle 150 located at an upper portion of the weight stand 100, maximum leverage can be utilized in tilting and moving the weight stand 100. This configuration can lower incidences of strain in tilting and/or moving the weight stand 100 about a weight lifting platform. In some embodiments, the handle 150 is located anywhere along the stanchion 130.

In some embodiments, when the weight stand 100 comprises both a fender 124 and a handle 150, the user can step on the fender 124 and grip the handle 150. Then, the user can pull the handle 150 towards him or her to place a portion of the weight stand 100 on the rolling elements 120. In some embodiments, the handle 150 also facilitates steering of the weight stand 100 when the weight stand is balanced on a rolling element 120.

In some embodiments, the weight stand 100 comprises a plurality of handles. In some embodiments, for example, two handles can be located on a single side of the weight stand to facilitate loading and unloading of the weight stand onto a vehicle, maximizing the mobility of the weight stand.

Figure 1G:
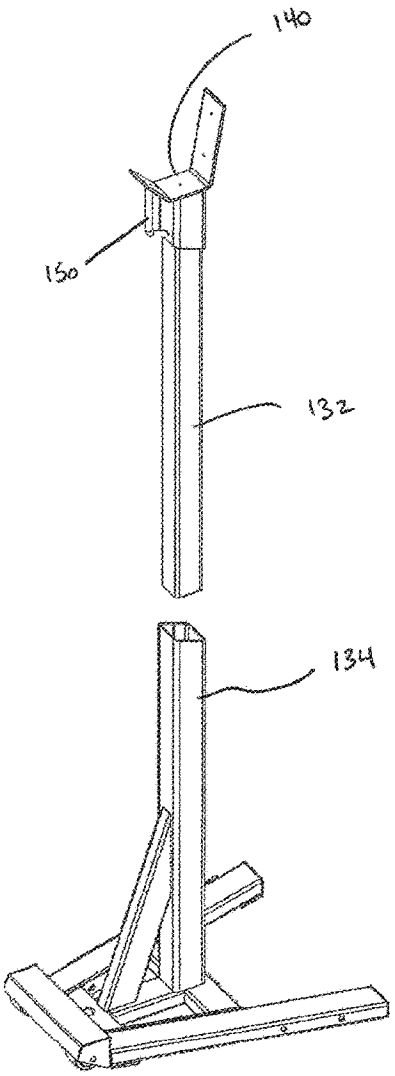
FIG. 1G is an exploded view of another embodiment of a weight stand.
Figure 1H:
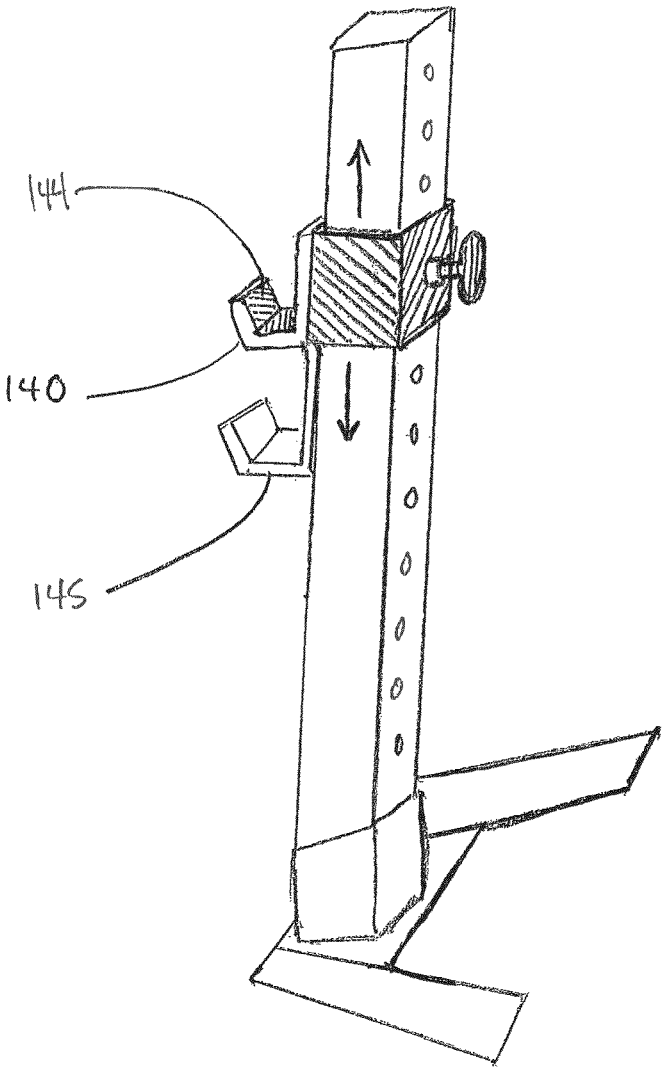
FIG. 1H is a perspective view of an embodiment of a single weight stand.
Figure 11:
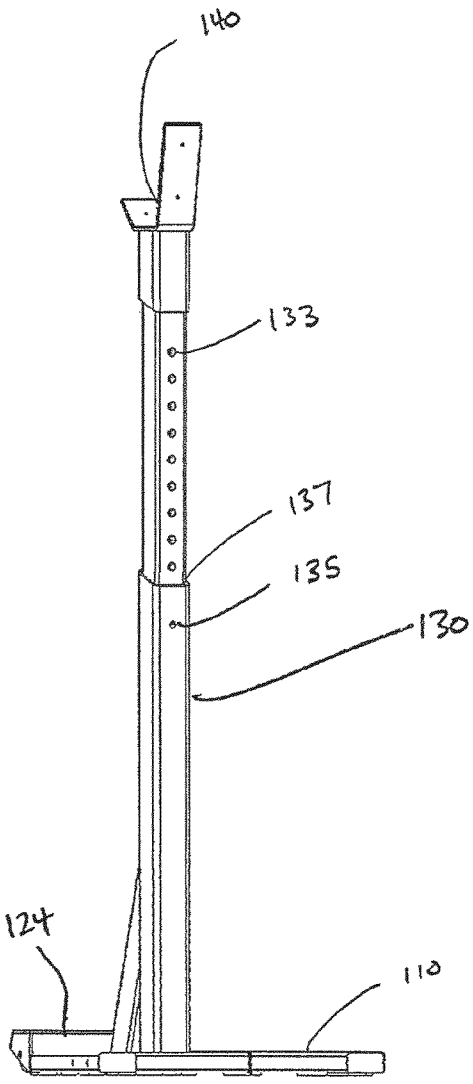

In some embodiments, the height of the weight stand (e.g. as measured as the distance from the foot to the support member) can be adjusted. In some embodiments, the stanchion comprises a male extension member/sheath design. In some embodiments, as shown in FIG. 1G, the support member 140 is attached (e.g. glued, welded, or otherwise affixed) to the male extension member 132. In some embodiments, when the support member is attached to the male extension member 132, the male extension member 132 can be extended upwardly out of a sheath 134, thereby increasing the height of the weight stand 100. In some embodiments, the support member is instead attached to the sheath and the sheath fits over the male extension member (which is, in turn, attached to the foot member). In this design, by moving the sheath upwardly, the height of the weight stand can be increased (see, e.g., FIG. 1H).

Figure 1J:
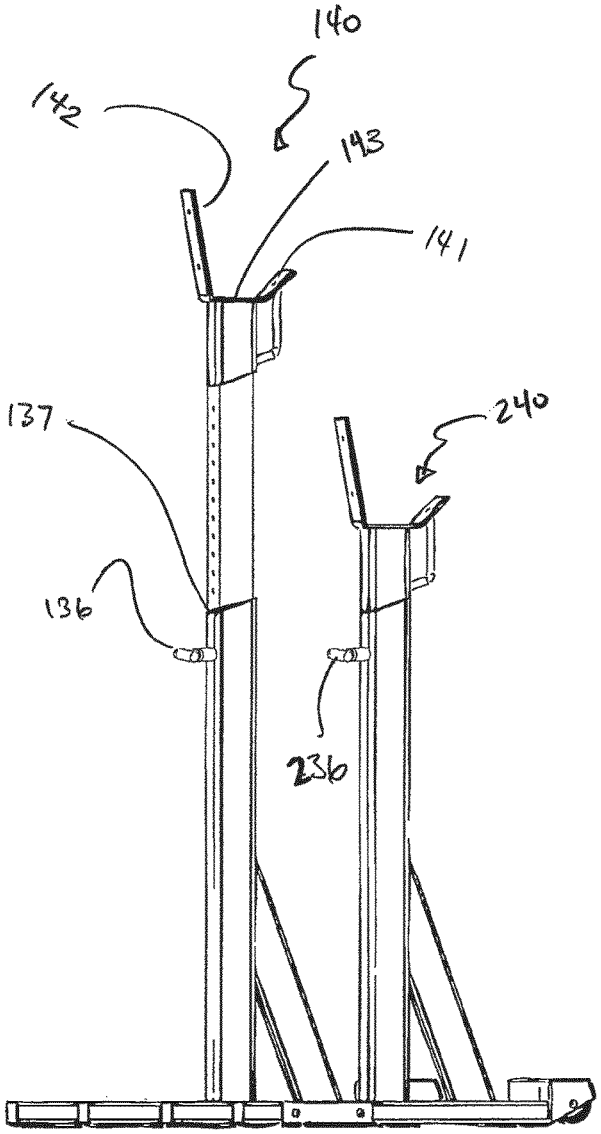
Figure 1K:
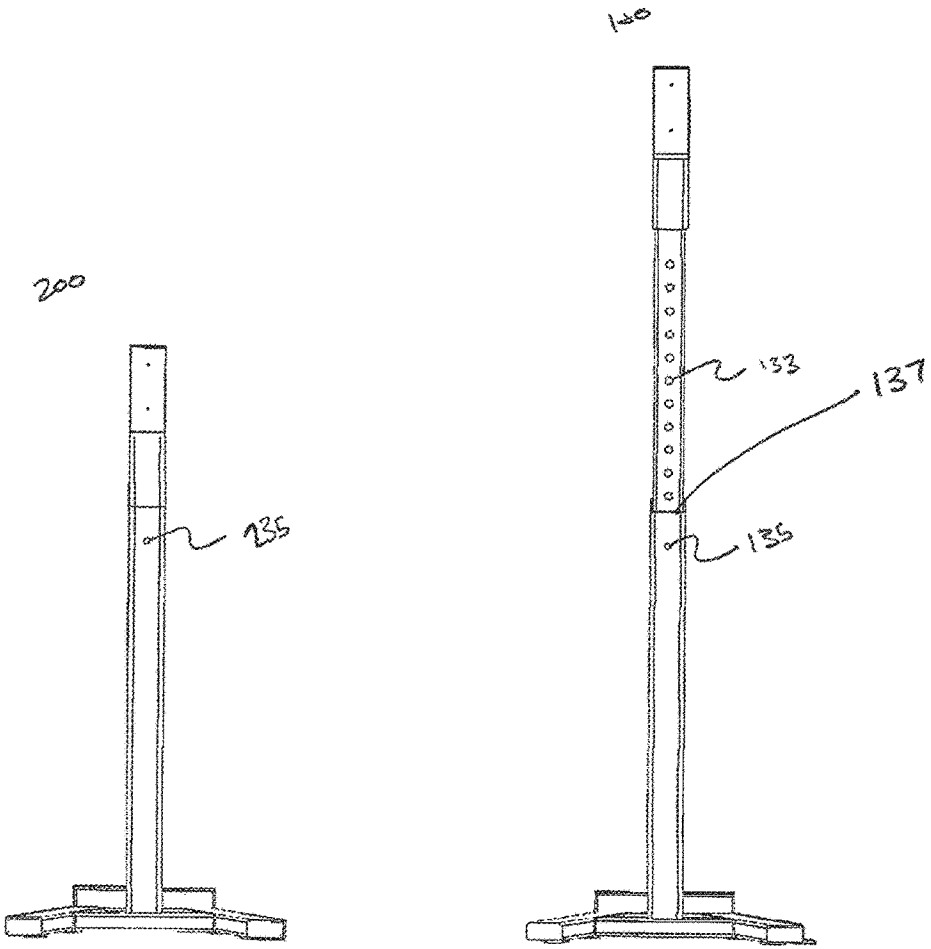

In some embodiments, the stanchion further comprises a securing member (e.g. a pin, a bolt, a clip, a screw, a rod, etc.) configured to engage the sheath 134 and/or the male extension member 132. In some embodiments, the normal exercise equipment pins, e.g., "u" or "T"-shaped can be used. In some embodiments, when the sheath 134 and/or male extension member 132 is engaged by the securing member, the support member 140 is maintained at a height above the foot member 110. In some embodiments, the securing member comprises a handle (e.g. a grip). In some embodiments, the securing member is configured to engage and insert through a sheath aperture 135 (located in the sheath) and simultaneously through an extension aperture 133 (located on the male extension member). When the securing member is inserted through the apertures of the male extension member 132 and the sheath 134, it secures the support member 140 at a preselected height. In some embodiments, as shown in FIG. 1I-K, the male extension member has a series of apertures 133 configured to be engaged by the securing member. These apertures allow several preselected heights to be selected for the weight stand support member 140 of the weight stand 100. In some embodiments, the apertures are about 2 inches apart so that the male extension member 132 can be raised or lowered in about 2 inch increments. In some embodiments, to allow adjustment of the weight stand height, the apertures are separated by a distance of about 1 inch, about 2 inches, 3 about inches, values in between the aforementioned values, and otherwise.

In some embodiments, the weight stand support member 140 can be adjusted to heights (e.g., over the surface below the weight stand) of at least 6", 1', 2', 3', 4', 5', 6', 7', heights in between the aforementioned values, and otherwise.

In some embodiments, the securing member comprises a pop pin design wherein the pop pin 136 is spring loaded. In the pop pin design, the securing member may be physically mounted (e.g. welded or screwed into place) to the sheath 134. In some embodiments, release of the pop pin 136 securing member allows the securing member to recoil through the sheath aperture 135 and into a corresponding male extension member aperture 133. For example, the pop pin 136 can be pulled out to allow movement of the male extension member 132 upwardly and downwardly within the sheath 134. Once an appropriate height is selected for the weight stand's 100 weight stand support member 140, the pop pin 136 can be released to engage the sheath aperture 135 and male extension member 133 simultaneously.

In some embodiments, as shown in FIG. 1J, the handle 150 is located on a side opposite the pop pin 136. This design provides added safety during height adjustment of the weight stand support member 140. For instance, by having the handle 150 on a side of the weight stand 100 opposite the pop pin 136, the user is encouraged to adjust the weight stand support member 140 height by, at once, using the handle 150 with one hand while simultaneously pulling and holding the pop pin 136 out with the other hand so that it disengages the extension aperture 133. The user's hands are simultaneously occupied at positions that are opposite from each other and away from the extension member insertion point 137. This decreases the pinch hazard for the user as he moves the extension member 132 in and out of the sheath 134.

As discussed above, the weight stand 100 comprises a support member 140. In some embodiments, the support member 140 is configured to support at least a portion of a barbell or other weightlifting bar. In some embodiments, the support member 140 is u-shaped and configured to receive a bar in the trough of the "u". In some embodiments, the support member any other shape suitable to receive at least a portion of a barbell (e.g., "v" shaped, "G" shaped, etc.), keeping in mind that the support member need only be configured to receive and support a portion of a barbell.

In some embodiments, as shown in FIGS. 1A-1J, the support member 140 is cradle-shaped and configured to receive a bar via the lower portion, front portion of the cradle. In some embodiments, the support member 140 is an asymmetric cradle with a bottom portion of the support member 143, a back portion of the support member 142 (coinciding with the back of the weight stand), and a front portion of the support member 141 (coinciding with the front of the weight stand). In the asymmetric cradle design, front portion of the support member 141 is lower than the back portion of the support member 142. This shape may facilitate safe removal and re-racking of the bar on the weight stand. For example, the weightlifter can adjust the height of the weight stand 100 so that, when in the standing or walking position, the bar can be lifted (e.g. on the shoulders) off the weight stand 100 and removed from the weight stand via the front of the weight stand. The weightlifter can then perform his or her weightlifting exercise. Then, upon re-racking of the weight after exercise, the weightlifter can approach the weight stand 100 from the front where the barbell passes over the front portion of the support member 141. After passing the front portion of the support member 141, when the support member is set at the appropriate height, the barbell on the weightlifter's back will then contact the back portion of the support member 142. At that point the weightlifter may release the weight into the bottom portion of the support member 143 and exit the barbell rack and platform. This design allows the weightlifter, by feel or sound alone, to determine when it is safe to release the weight and move out from under it.

In some embodiments, the front portion of the support member 141 is attached to the handle 150. This configuration may allow the user to simultaneously engage the support member cradle and the handle 150 with a single hand to facilitate tilting or other movement of the weight stand.

In some embodiments, the weight stand comprises a material selected from the group consisting of titanium, iron, steel, aluminum, nylon, high-density polyethylene, polypropylene, polystyrene and combinations thereof. In some embodiments, the weight stand comprises steel. In some embodiments, the weight stand comprises 7 gauge steel tubing. In some embodiments, the weight stand comprises 11 gauge steel tubing.

In some embodiments, the support member 140 further comprises a protective cover. In some embodiments, the protective cover comprises rubber, foam, polymer composite, high-impact resistant polyethylene, and combinations thereof. In some embodiments, the protective cover comprises a material selected from the group consisting of rubber, foam, polymer composite, high-impact resistant polyethylene, and combinations thereof.

In some embodiments, as discussed above, the weight stand comprises a second support member configured to attach to the stanchion. In some embodiments, the second support member can be located a distance below the support member to allow weightlifters of different heights to use the weight rack simultaneously. The second support member can also be used as a safety catch for a barbell during a failed lift.

In some embodiments, the weight stand comprises a second stanchion with a second support member. The second support member may be located on a side of the support member and is configured to support an additional portion of a barbell. In embodiments, where only one weight stand is provided, the second support member allows the user to support the barbell with less risk of tipping.

Figure 1L:
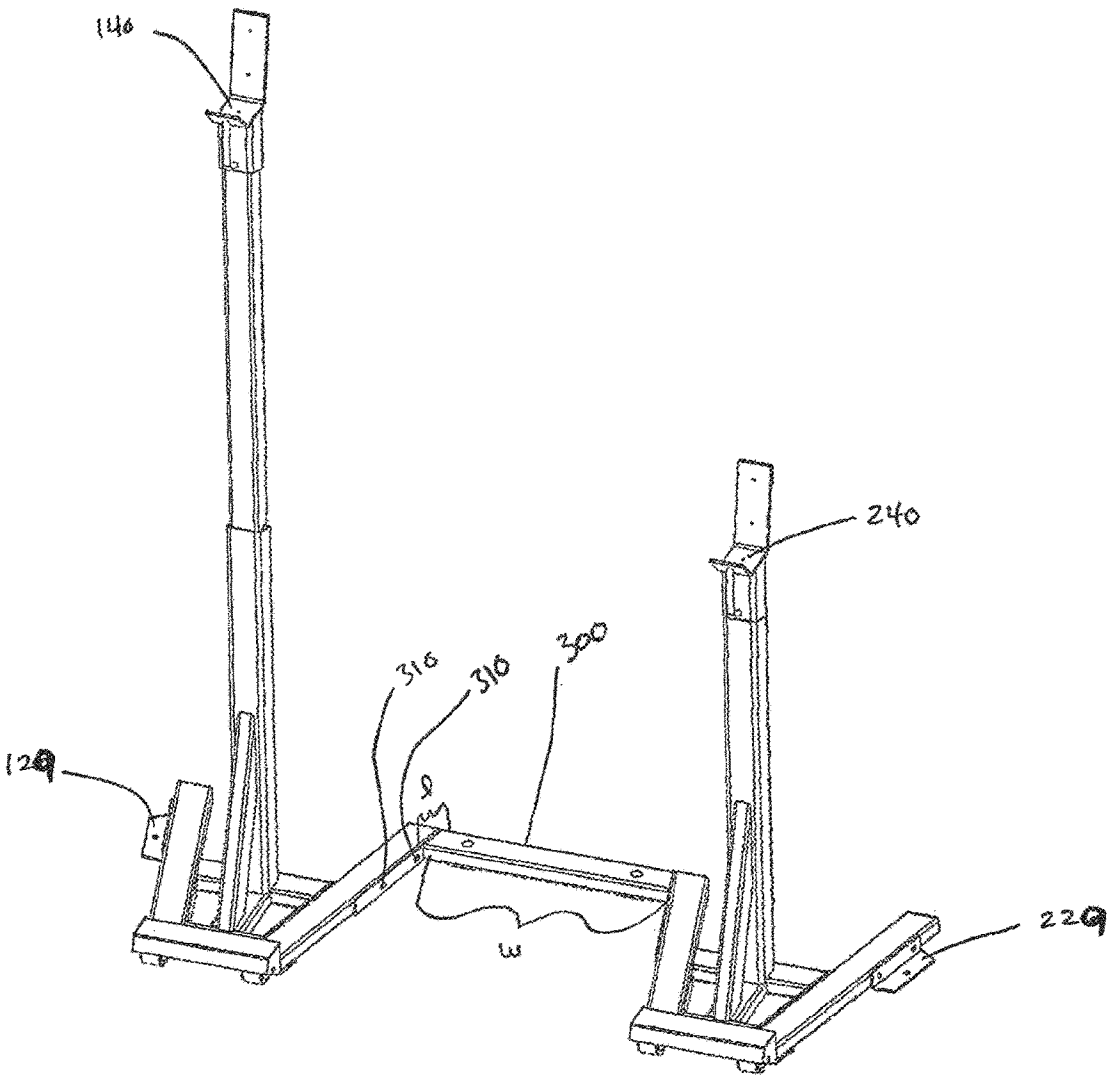
FIG. 1L is a perspective view of an embodiment of a weight rack having connected weight stands.

In some embodiments, when two weight stands are present, the barbell rack further comprises a spacer unit 300 having a width w extending between a side of the first weight stand 100 and a side of the second weight stand 200 as shown in FIG. 1L. The spacer unit 300 also has a length 1 extending substantially perpendicularly to the spacer width w. In some embodiments, the spacer 300 spans a distance between the first weight stand 100 and the second weight stand 200. In some embodiments, the spacer unit 300 provides an appropriate distance between the two weight stands to allow the support members 140, 240 of the weight stands 100, 200 to cooperatively support a barbell. In some embodiments, the spacer 300 separates the weight stand support members 140, 240 a distance such that the each support member engages the barbell less than about 1 cm, 5 cm, 10 cm, 20 cm, or 30 cm from the collar of the barbell. In some embodiments, the spacer 300 has a width ranging from between about 1 to about 10 cm, about 10 cm to about 20 cm, about 20 cm to about 30 cm, about 30 cm to about 40 cm, about 40 cm to about 50 cm, about 50 cm to about 75 cm, or about 75 to about 100 cm. In some embodiments, the spacer has a width greater than about 1 cm, 10 cm, 20 cm, 30 cm, 40 cm, 50 cm, 75 cm, 100 cm, values in between the aforementioned values, and otherwise.

In some embodiments, the spacer unit 300 further comprises a locking mechanism 310 configured to secure a weight stand 100, 200 in position. In some embodiments, the spacer further comprises a second locking mechanism configured to secure the second weight stand. When both locking mechanisms are engaged, the barbell rack functions as a single piece and can be moved as a single unit via the rolling elements on each or one of the foot members. In some embodiments, the locking mechanism 310 may comprise any instrument (e.g. a pin, a bolt, a clip, a screw, a rod, etc.) configured to attach the weight stand to the spacer.

Some embodiments pertain to methods of making a barbell rack comprising providing a foot member, providing a support member configured to be attached to the foot member, providing a rolling element configured to attach to the foot member, and providing a stanchion configured to connect the support member to the foot member.

Plate Rack

Some embodiments provide a plate rack for holding one or more weight plates. A weight plate can be of any suitable material (e.g., metal, rubber, plastic, composite, and combinations thereof). A standard Olympic lifting weight plate, or "bumper" plate, has an external circumference that is rubber and an inner circumference that is a metal plate, configured to allow movement onto and off of a barbell. Olympic weightlifting bumper plates also often have different widths based on the heaviness of the weight. For example, a 25 kg plate will have a larger width than a 20 kg plate, which will have a larger width than a 15 kg plate, which will have a larger width than a 10 kg plate, which will have a larger width than a 5 kg plate. However, each of these different weight plates can have the same circumference and diameter.

Figure 2A:
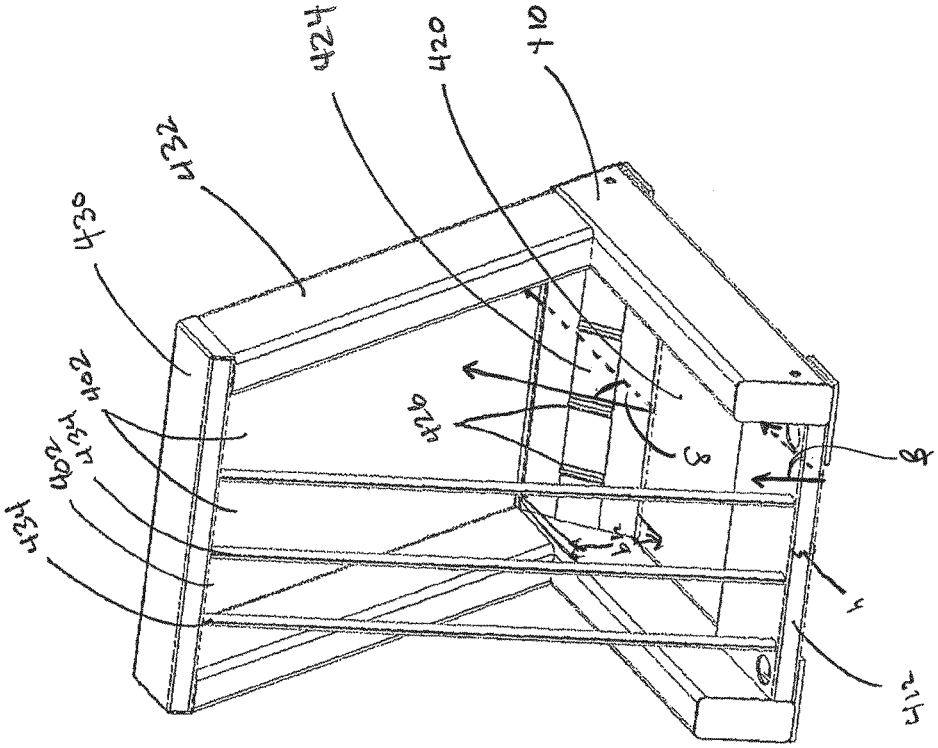

In some embodiments, the plate rack 400 comprises a plate rack base 410 and a cradle portion 420 (as shown in FIG. 2A). In some embodiments, the plate rack base 410 is configured to allow a weight plate to roll into the cradle portion 420 via the circumferential periphery of the weight plate, wherein the cradle portion 420 is configured hold the weight plate and to inhibit forward or backward rolling of the weight plate along the circumferential periphery of the weight plate.

In some embodiments, one or more the plate racks are can be used on a single weight lifting platform. For instance, a typical weight lifting platform accommodates a weight lifter and a barbell. A barbell has a weight bearing portion on each end and is configured to hold one or more weight plates or weight discs on each end. Two or more plate racks 440 can be positioned to reside on either side of the weight lifting platform and, thus, towards and in proximity to each end of the barbell. In such a configuration, the barbell can be easily and quickly loaded and unloaded without wasted effort from the user. The user can roll a plate out of the plate rack 440 and align it with the barbell while the plate is on the ground, never lifting it off the ground. The weight plate can then easily be slid onto the weight bearing portion of the bar with minimal effort. When the weight lifting exercise is completed, the weights can be slid off the bar and rolled back into position in the weight rack. This offers a distinct advantage over conventional plate racks which require the user to lift the weight out of the rack. Lifting a weight plate can force the user to adopt unnatural positions as he or she may have to reach over a conventional rack to lift a weight. Lifting these heavy plates out of a rack can lead to injury and strain of the user. Embodiments described herein avoid these disadvantages by providing a unique roll-in/roll-out design for adding and removing weight plates without the need for lifting the weights off during racking and unracking.

In some embodiments, the plate rack 400 is configured to hold a plurality of weight plates. For instance, in some embodiments, the plate rack holds 1, 2, 3, 4, 5, 6, 7, 8, 9, 10, or more weight plates.

In some embodiments, as shown in FIG. 2A, the base 410 further comprises an external ramp 412 configured to allow a weight plate to roll from a floor into the plate rack base 410 and into the cradle 420. In some embodiments, the external ramp 412 creates an angle β with respect to a surface below the plate rack 400. In some embodiments, the ramp is flat. In some embodiments, the angle β ranges from about 10° to about 60°. In some embodiments, angle β ranges from about 1° to about 10°, about 10° to about 20°, about 20° to about 30°, about 30° to about 40°, about 40° to about 50°, about 50° to about 60°, about 60° to about 70°, about 70° to about 80°, or about 80° to about 90°. In some embodiments, angle β ranges from about 1° to about 90°, about 10° to about 80°, about 20° to about 70°, about 30° to about 60°, or about 40° to about 50°.

In some embodiments, the external ramp 412 has a height h, as shown in FIG. 2A. In some embodiments, h ranges from about 0 mm to about 5 mm, about 5 mm to about 10 mm, about 10 mm to about 20 mm, about 20 mm to about 30 mm, about 30 mm to about 40 mm, about 40 mm to about 50 mm, or about 50 mm to about 100 mm. In some embodiments, h is less than about 1 mm, 2.5 mm, 5 mm, 7.5 mm, 10 mm, 15 mm, 20 mm, 30 mm, 40 mm, 50 mm, 60 mm, 75 mm, 100 mm, or values in between the aforementioned values, and otherwise.

Figure 2B:
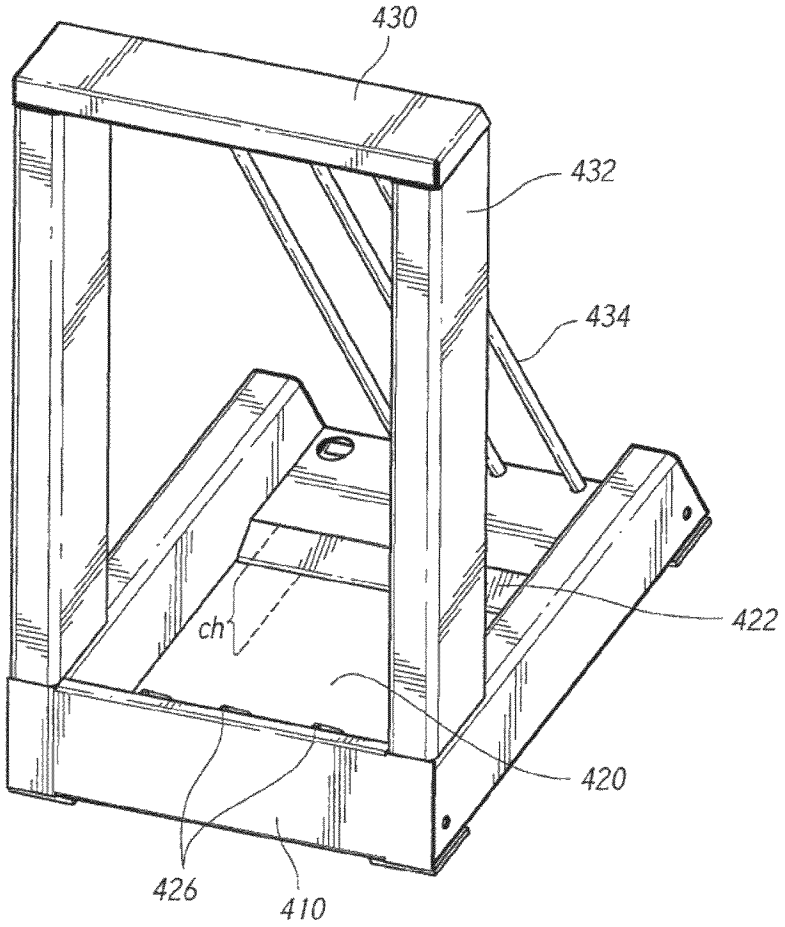

In some embodiments, as shown in FIG. 2B, the cradle portion 420 further comprises an internal ramp 422 configured to allow the first weight plate to roll out of the cradle portion 420 or into the cradle portion 420. In some embodiments, the internal ramp 422 creates an angle γ with respect to a surface below the plate rack 400. In some embodiments, the angle γ ranges from about 10° to about 60°. In some embodiments, angle γ ranges from about 1° to about 10°, about 10° to about 20°, about 20° to about 30°, about 30° to about 40°, about 40° to about 50°, about 50° to about 60°, about 60° to about 70°, about 70° to about 80°, or about 80° to about 90°. In some embodiments, angle γ ranges from about 1° to about 90°, about 10° to about 80°, about 20° to about 70°, about 30° to about 60°, or about 40° to about 50°.

In some embodiments, the internal ramp 422 has a height ch, as shown in FIG. 2B. In some embodiments, ch ranges from about 0 mm to about 5 mm, about 5 mm to about 10 mm, about 10 mm to about 20 mm, about 20 mm to about 30 mm, about 30 mm to about 40 mm, about 40 mm to about 50 mm, or about 50 mm to about 100 mm. In some embodiments, ch is less than about 1 mm, 2.5 mm, 5 mm, 7.5 mm, 10 mm, 15 mm, 20 mm, 30 mm, 40 mm, 50 mm, 60 mm, 75 mm, 100 mm, or values in between the aforementioned values, and otherwise.

In some embodiments, as shown in FIG. 2A, the cradle 420 further comprises a backstop 424 located on an opposite side of the plate rack base 410 from the internal ramp 422 and configured to prevent rolling of the weight plate pass the backstop 424. In some embodiments, the backstop 424 forms an angle δ with respect to the surface below the plate rack 400. In some embodiments, the angle δ ranges from about 10° to about 60°. In some embodiments, angle δ ranges from about 1° to about 10°, about 10° to about 20°, about 20° to about 30°, about 30° to about 40°, about 40° to about 50°, about 50° to about 60°, about 60° to about 70°, about 70° to about 80°, or about 80° to about 90°. In some embodiments, angle δ ranges from about 1° to about 90°, about 10° to about 80°, about 20° to about 70°, about 30° to about 60°, or about 40° to about 50°.

In some embodiments, the backstop 424 has a height bh, as shown in FIG. 2A. In some embodiments, bh is taller than h. In some embodiments, bh ranges from about 0 mm to about 5 mm, about 5 mm to about 10 mm, about 10 mm to about 20 mm, about 20 mm to about 30 mm, about 30 mm to about 40 mm, about 40 mm to about 50 mm, about 50 mm to about 100 mm, about 100 mm to about 200 mm, or from about 200 mm to about 400 mm. In some embodiments, bh is greater than about 1 mm, 2.5 mm, 5 mm, 7.5 mm, 10 mm, 15 mm, 20 mm, 30 mm, 40 mm, 50 mm, 60 mm, 75 mm, 100 mm, 200 mm, 300 mm, or is a value in between the aforementioned values, and otherwise.

In some embodiments, instead of a backstop the cradle further comprises an additional internal ramp on an opposite side of the plate rack base from the internal ramp. In some embodiments, the dual ramp system is configured to allow weight plates to roll out of the cradle onto one of two platforms on either side of the plate rack. In some embodiments, both ramps are configured to allow rolling of the weight plate out of the cradle, but provide enough resistance to prevent a weight plate from rolling out of the weight rack without a force exerted by a user. In some embodiments, the additional internal ramp can have any one of the features described above for the internal ramp (e.g., height, angle with respect to the surface below the plate rack, etc.). In some embodiments, the additional internal ramp can have features that are different from those of the internal ramp.

In some embodiments, the plate rack further comprising a stabilizing element configured to hold a weight plate in a position to allow rolling of the plate on its circumferential periphery. In some embodiments, the weight rack the stabilizing element is a stabilizing protrusion 426. In some embodiments, as shown in FIGS. 2A-2B, the stabilizing protrusion 426 can be located on the backstop 424. In some embodiments, a stabilizing lip can be located on one or more of the internal ramp, the additional internal ramp, or the backstop.

In some embodiments, as shown in FIGS. 2A-2B, the plate rack 400 further comprises a frame 430. In some embodiments, the frame 430 comprises a buttress member 432 configured support a portion of the frame 430 and to maintain a weight plate in the substantially vertical position.

In some embodiments, the frame further comprises a divider 434 configured to separate two weight plates resting in the cradle portion 430 of the plate rack 400. In some embodiments, the plate rack 400 comprises several dividers 434. In some embodiments, the dividers 434 serve to guide a weight plate into the cradle portion 420 and to separate one or more weight plates from one or more other weight plates to provide easy user selection of a particular weight plate. In some embodiments, as shown in FIGS. 2A-2B, the plate rack 400 has both stabilizing protrusion 426 and dividers 434 to provide spacing of weight plates. In some embodiments, the plate rack has either stabilizing lips or dividers, or neither stabilizing lips nor dividers.

In some embodiments, the dividers 434 and or the stabilizing protrusion 426 are separated by different distances to allow different thicknesses of weight plates to pass through (i.e. each slot can be configured to hold a bumper plate of different weight). For example, in some embodiments, the plate rack 400 is configured to hold different weight plate sizes in each weight plate reservoir 402. In some embodiments, the weight plate reservoirs can be of the same size. In some embodiments, the dividers 434 can be spaced any combination of distances to accommodate any size of bumper plate and any configuration of weight denominations.

Figure 2C:
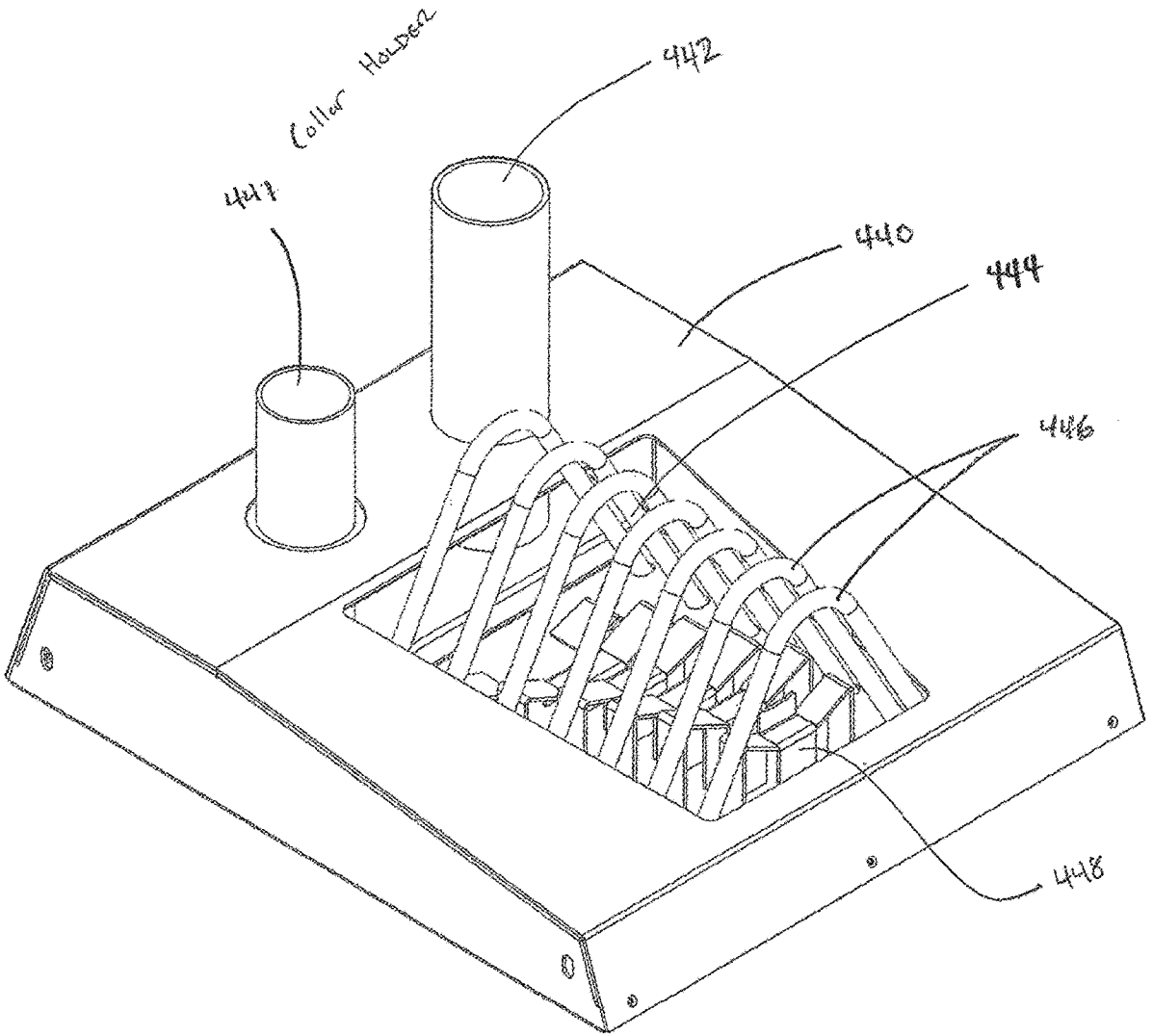
Figure 2D:
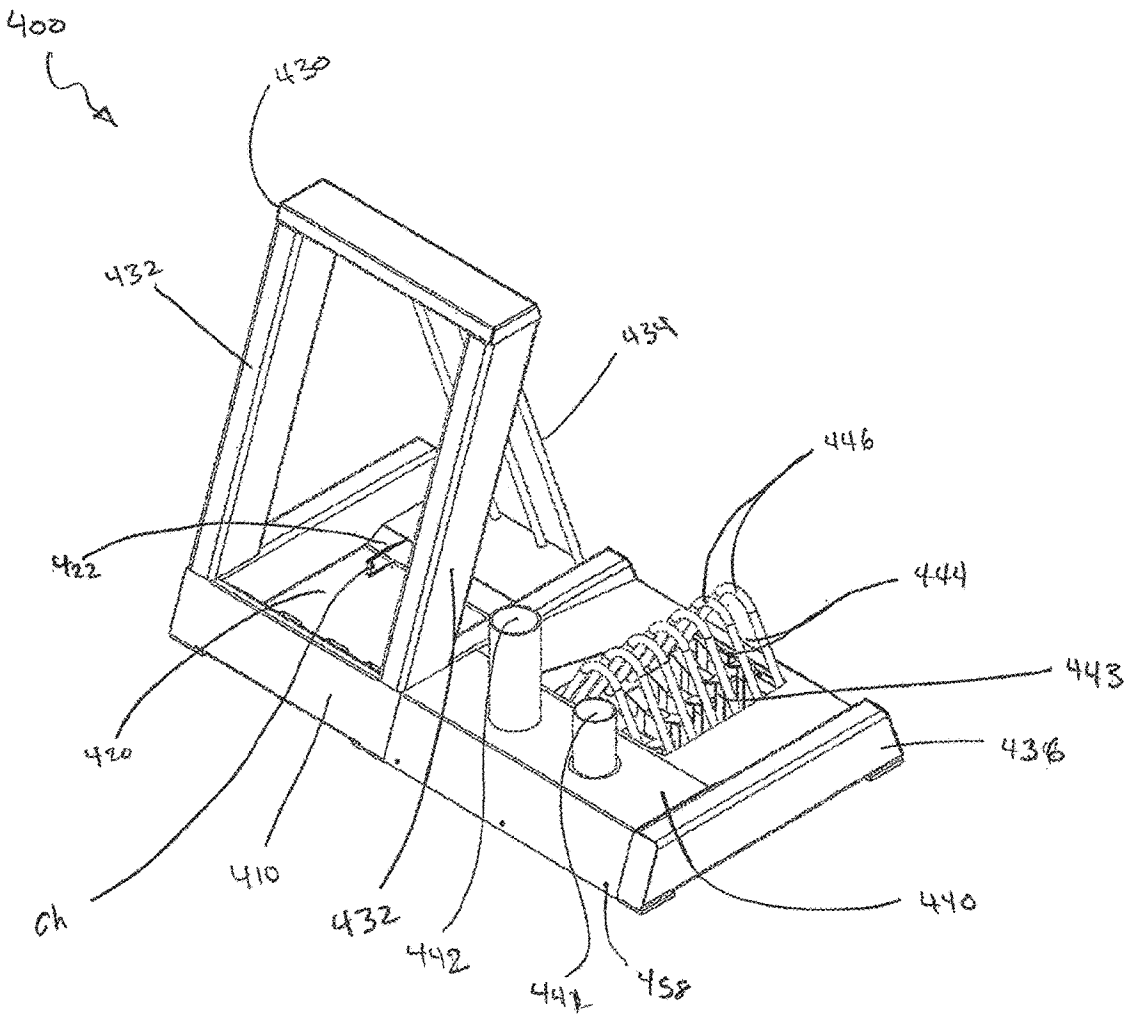

FIG. 2C shows a secondary housing 440. In some embodiments, the secondary housing 440 attaches to the plate rack base 410 via a secondary housing extension unit which may fit below the secondary housing 440. Different configurations of secondary housings can be attached to the plate rack base using the secondary housing unit. In some embodiments, as shown in FIGS. 2D-2G, the plate rack 400 can be attached to the secondary housing 440.

In some embodiments, as shown in FIGS. 2C-2G, the secondary housing comprises a weight disc holding portion 443. The weight disc holding portion 443 is shown removed from the housing in FIGS. 2I-2K. In some embodiments, the weight disc holding portion 443 comprises a weight disc slot 444, a weight disc divider 446, and a weight disc pedestal 448. Like other components described herein, the weight disc holding portion 443 is modular and different weight disc holding portions can be swapped in and out of the secondary housing 440, or attached directly to the base via an base extension or a side of the base (for example, when a secondary housing is not used). In some embodiments, these different weight disc holding portions allow maximum freedom in weight holder selection. In some embodiments, the weight disc holding portion 443 of the secondary housing 440 is configured to receive 1, 2, 3, 4, 5, 6, 7, 8, 9, 10, or more weight discs. In some embodiments, the secondary housing 440 is configured to receive 1, 2, 3, 4, 5, 6, 7, 8, 9, 10, or more weight disc holding portions.

In some embodiments, as shown in FIGS. 2C-2K, the weight disc holding portion 443 comprises one or more weight disc slots 444. These disc slots 444 allow a weight disc to be lifting in and out of, for example, the secondary housing 440. A weight disc typically weighs less and is smaller than a weight plate. For instance, typical weights of weight discs are 5 kg, 2.5 kg, 2.0 kg, 1.5 kg, 1.25 kg, 1.0 kg, 0.5 kg, or otherwise. Because the weight discs are somewhat lighter than the weight plates, they are easier to lift out of the plate rack 440 and easier to place onto a barbell without strain or excess effort. Thus, the lift-in/lift-out design carries little risk in injuring or straining the user because the weights are relatively light while at the same time offering a convenient way of storing a weight disc. A weight disc can be of any suitable material (e.g. metal, plastic, rubber, composite, and/or combinations thereof). Furthermore, the disc slots 444 can be sufficiently small to only allow small/light weight discs to be placed between the weight disc dividers. This feature may be used to discourage heavy plates from being placed in a weight slot that requires lifting to remove the plate.

Figure 2F:
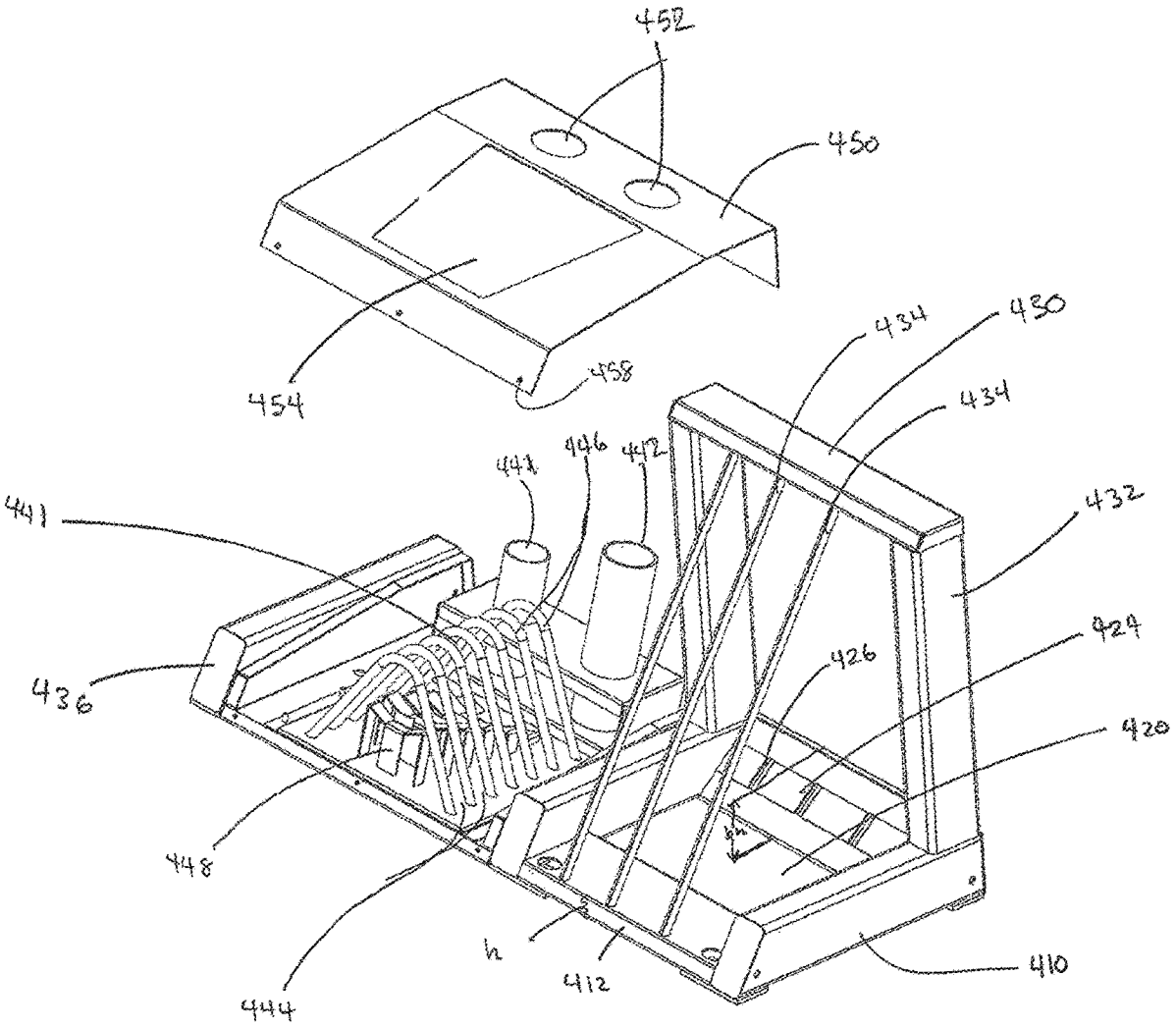
Figure 26:
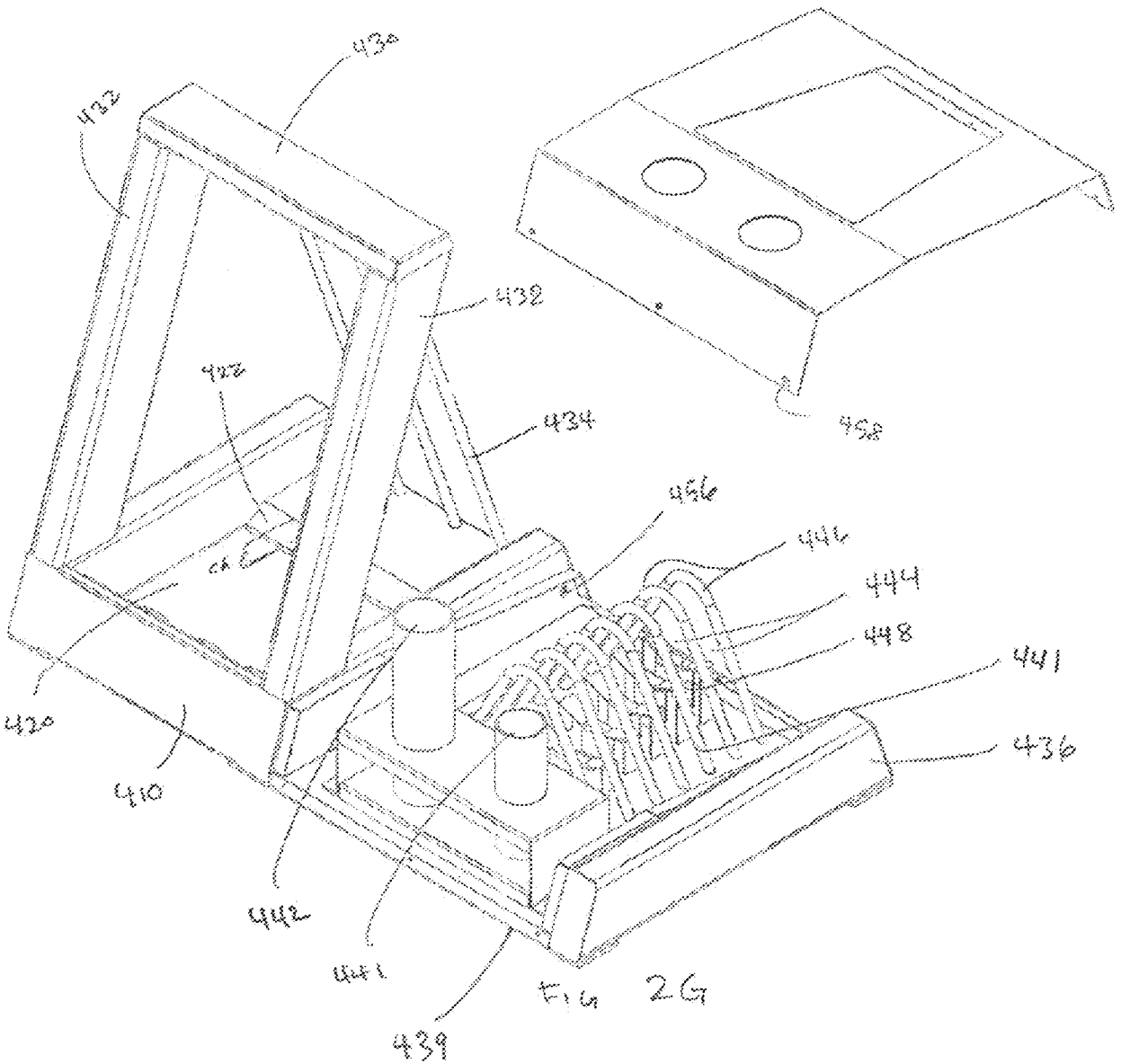
Figure 24:
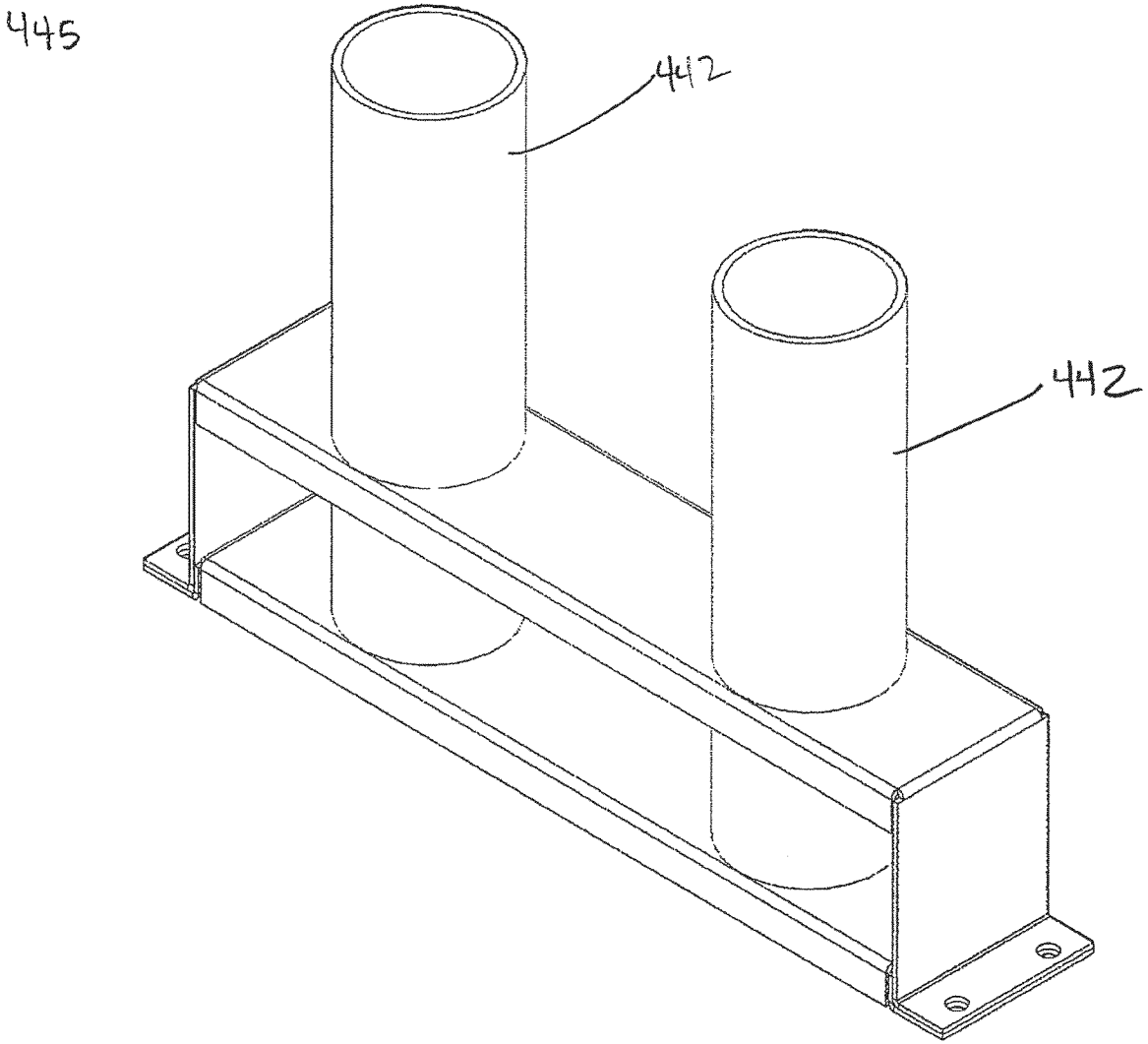
Figure 21:
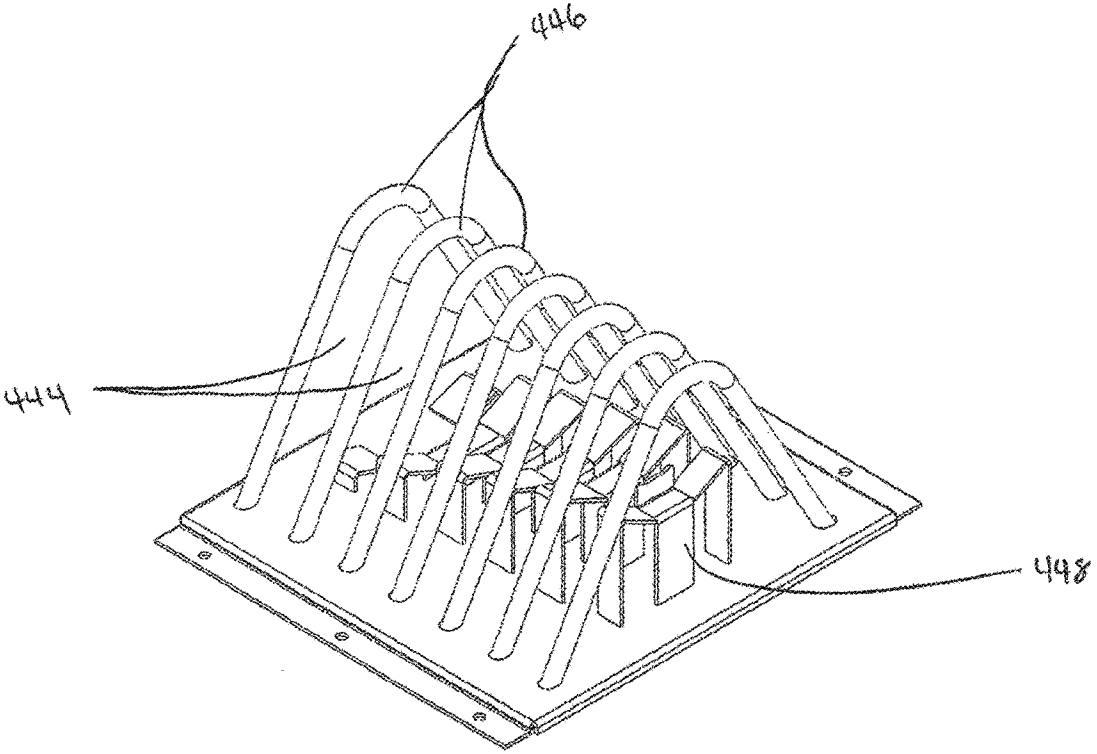
Figure 25:
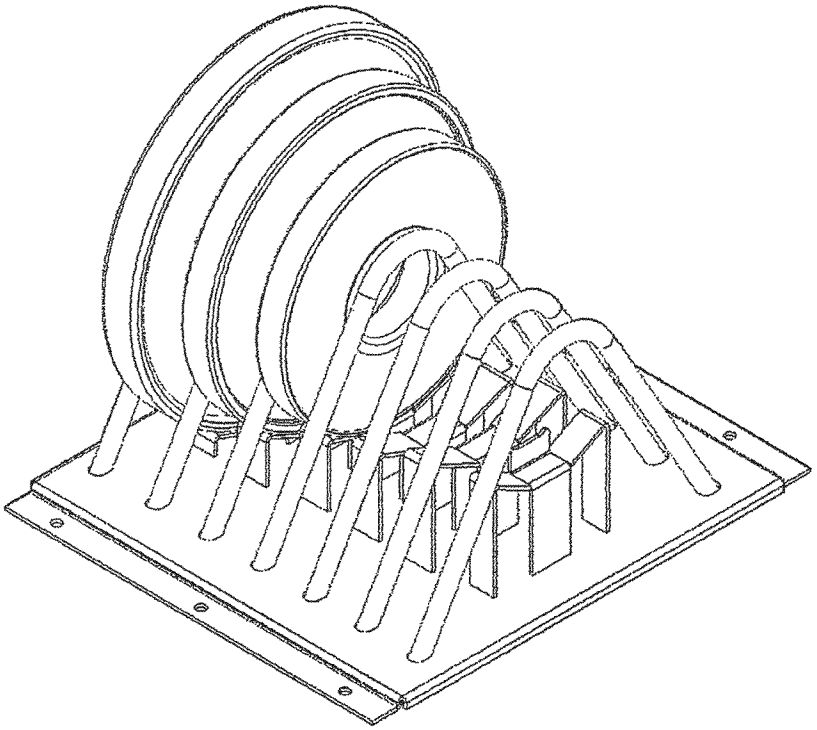
Figure 2K:
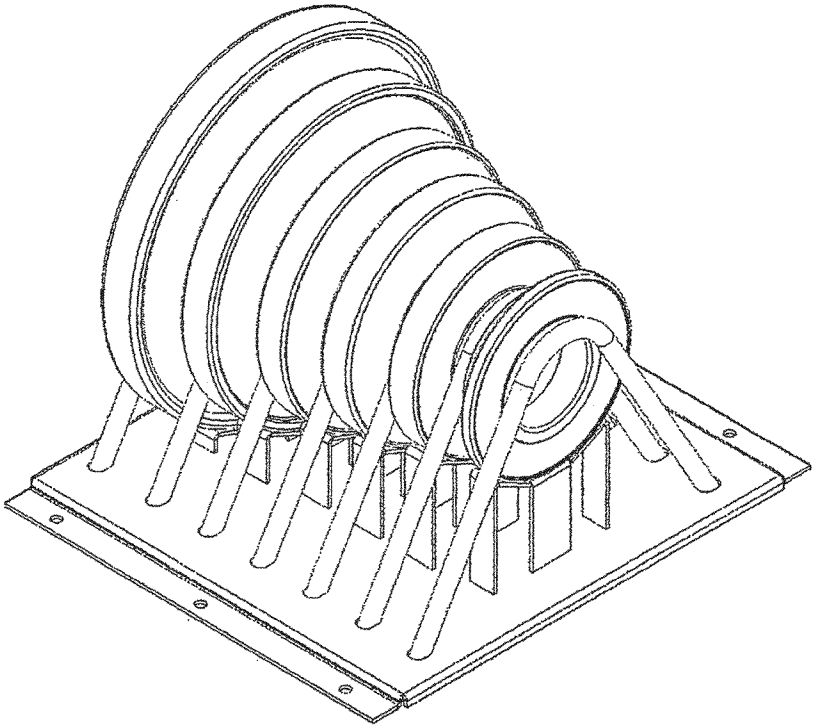
Figure 2L:
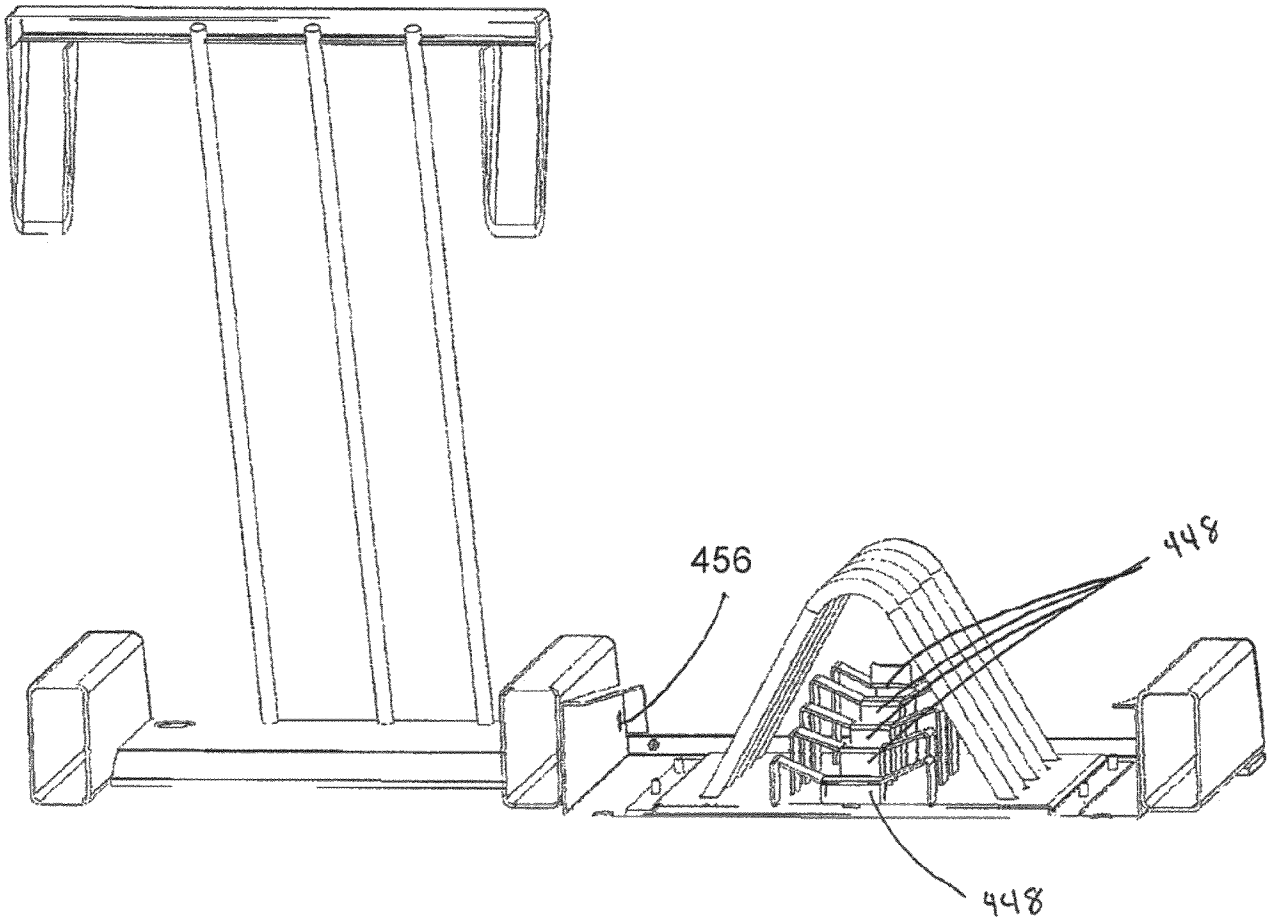
FIG. 2L is a bisected view of a plate rack with the housing cover removed.

In some embodiments, as shown in FIGS. 2I-K, the weight disc slots 444 are separated by weight disc dividers 446. In some embodiments, each weight disc slot 444 comprises a weight disc pedestal 448. As shown in FIG. 2L, a bisected view of the plate rack 400, the pedestals 448 can be of different heights to accommodate different size weight discs. Also as shown in FIG. 2L, the weight disc pedestals 448 can have different shapes (e.g. semi-circular, semi-polygonal) to hold and align the weight disc in position in the secondary housing 440. In some embodiments the weight disc pedestal 448 is configured to support a different size weight discs at different heights to allow easy access to the weight discs.

In some embodiments, the secondary housing 440 comprises a barbell receiver 442 configured to hold a barbell. In some embodiments, as shown in FIGS. 2C-2G, the secondary housing 440 may comprise a barbell receiver 442. In some embodiments, as shown in FIGS. 2C-2G, the barbell receivers 442 can hold a barbell in a substantially upright position via the weight bearing portion of the barbell. In some embodiments, as shown in FIG. 2C-2G, the barbell receivers 442 can be the same or of different shapes and sizes to facilitate holding men's bars, women's bars, trainer bars, and combinations thereof. In some embodiments, as shown in FIG. 2H, a barbell receiver unit 445 is provided. The barbell receiver unit 445 can be easily removed or replaced by fastening it to a base of the secondary housing 440.

In some embodiments, as shown in FIGS. 2C-2G, the secondary housing further comprises a member configured to support a barbell collar 441 (e.g., a collar holder). In some embodiments, multiple collar holders can be used. In some embodiments, the secondary housing 440 comprises 1, 2, 3, 4, 5, 6, 7, 8, or more collar holders. Additionally, in some embodiments, FIG. 2D, an end unit 436 can be added to a side of the plate rack (e.g., to conceal fasteners, bolts, etc.).

In some embodiments, as shown in FIGS. 2A-2C and 2G the secondary housing 440 and the plate rack base 410 are fully disconnectable and modular. This modular design allows different plate rack bases 410 or different secondary housings 440 to be swapped into and out of the plate rack 400. In some embodiments, as shown in FIG. 2G, the secondary housing attaches to the plate rack via a housing locking mechanism 456 (e.g. a pin, a bolt, a clip, a screw, a rod, etc.), wherein the housing locking mechanism 456 is configured to allow the plate rack base 410 and the secondary housing 440 to be separated.

In some embodiments, the one or more barbell receiver housing, which comprises the one or more barbell receivers 442, is also modular. Thus, different barbell receiver housing portions can be swapped out of the secondary housing 440 to allow maximum freedom in barbell receiver 442 selection.

In some embodiments, as shown in FIGS. 2F and 2G, the secondary housing 440 of the plate rack 400 further comprises a removable housing cover 450. In some embodiments, the removable housing cover has one or more barbell receivers apertures 452 and/or one or more weight disc holding portion apertures 454. These apertures allow the weight disc holding portion (where present) and the barbell receivers (where present) to pass through removable housing cover 450 and to be exposed for us on the secondary housing 440.

In some embodiments, the removable housing cover 450 attaches to the secondary housing 440 via a cover securing mechanism 458 (e.g. a pin, a bolt, a clip, a screw, a lock, etc.). These mechanisms help prevent dust from entering the secondary housing 440.

Figure 2M:
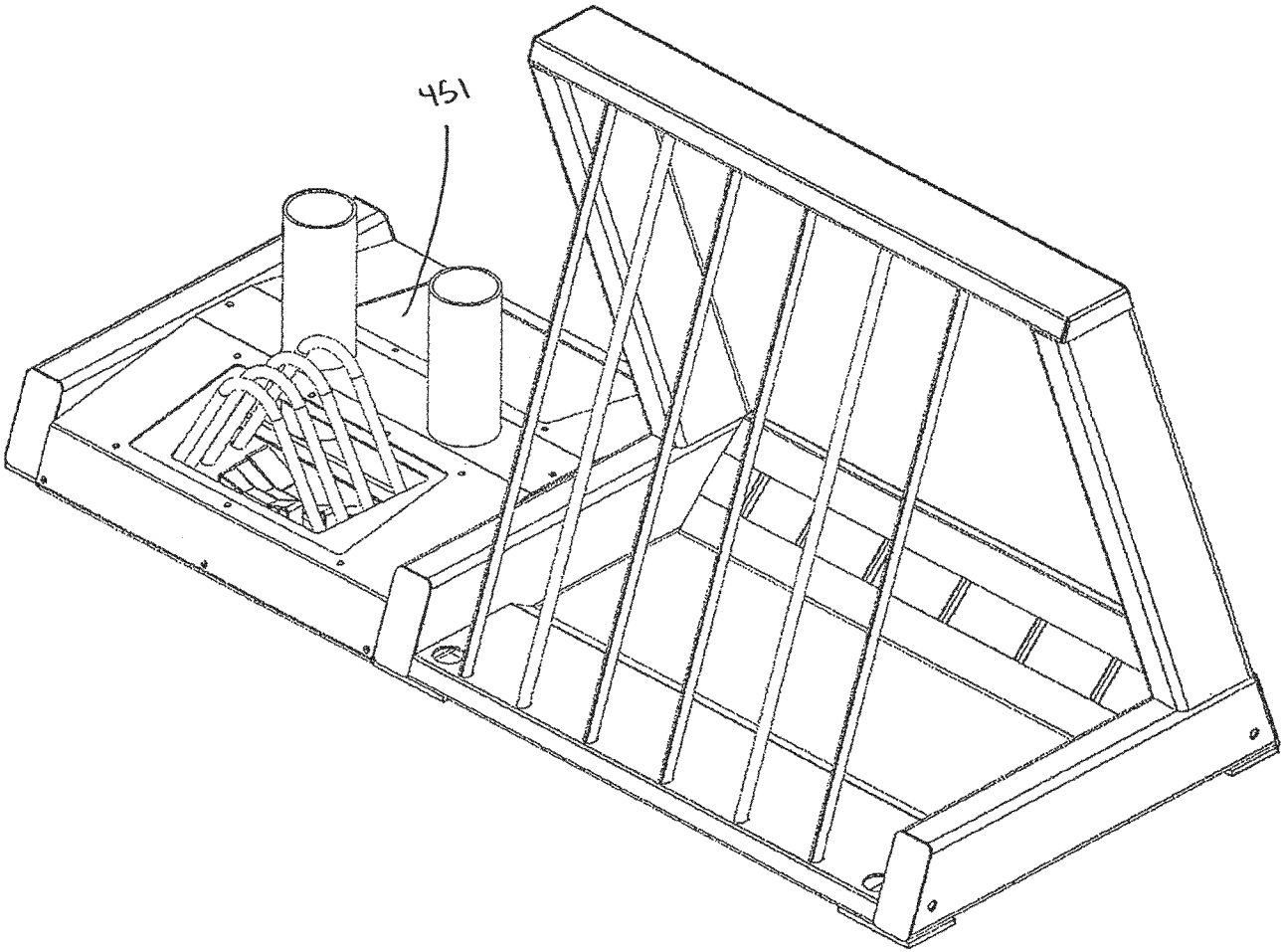
FIG. 2M is a perspective view of an embodiment of a plate rack.
Figure 22:
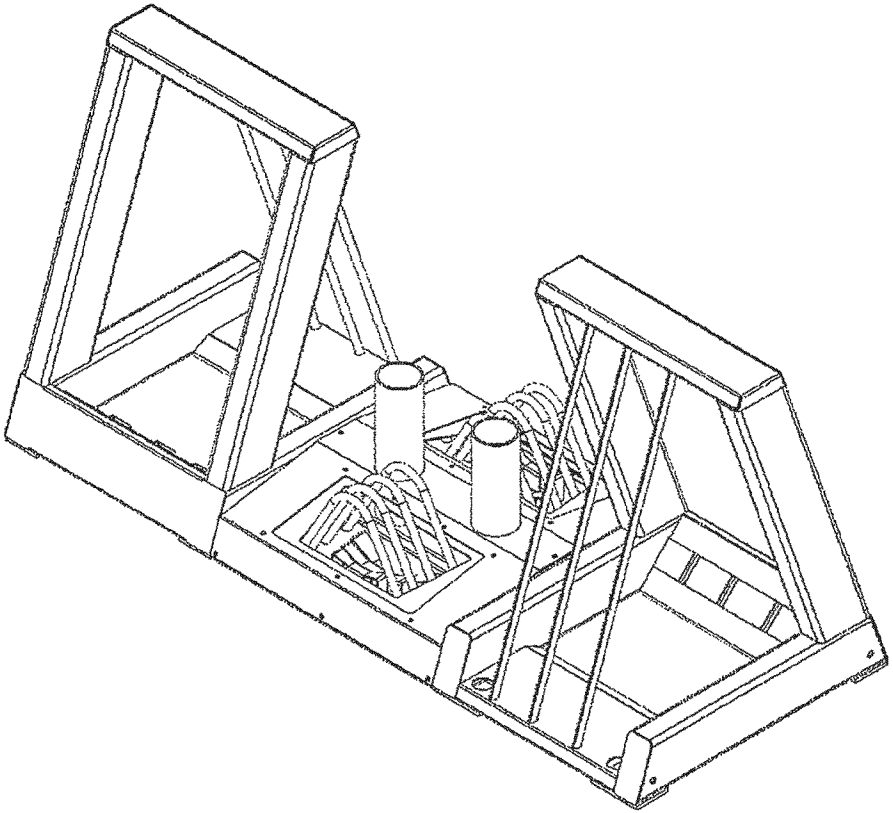
Figure 20:
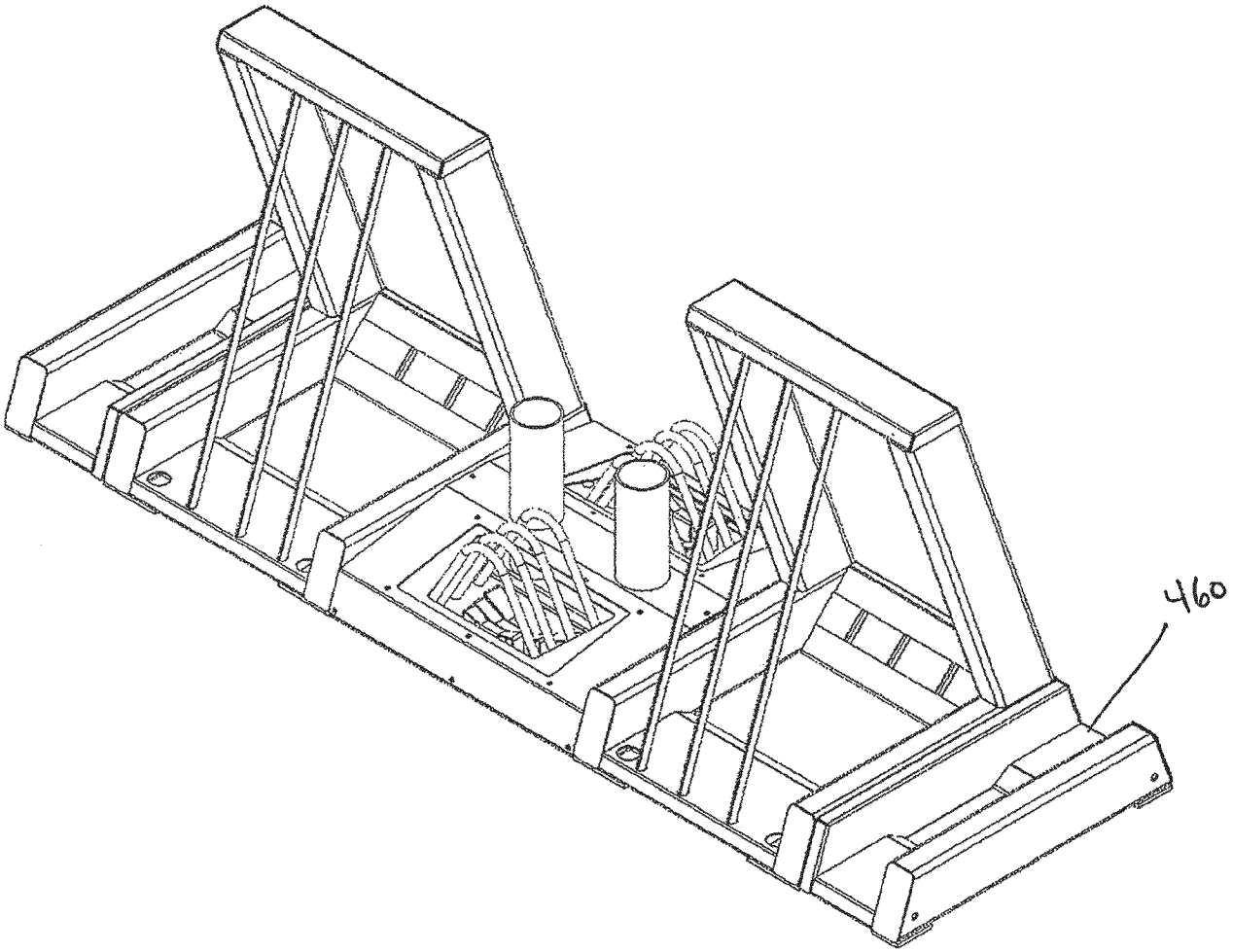

In some embodiments, different housing covers 450 can be used to accommodate different configurations of weight disc holding portions and barbell receiver housings. In some embodiments, the apertures can be sealed, for example, as shown in FIG. 2M, by a housing cover seal 451.

In some embodiments, the plate rack comprises more than base (as shown in FIGS. 2N and 2O) or more than one secondary housing. In some embodiments, additional plate rack bases can be used or additional secondary housings can be used. In some embodiments, plate rack bases, as described above and elsewhere in this description, without secondary housings are provided. In some embodiments, secondary housings, as described above and elsewhere in this description, without plate rack bases are provided.

FIGS. 2N and 2O show an embodiment of a plate rack having two bases and one secondary housing. In some embodiments, the bases can be directed towards opposite sides (as shown in FIG. 2N) so that weights are available for adjacent weight lifting platforms. In some embodiment, the bases can be directed towards the same side (as shown in FIG. 2O) so that two sets of weights are available for one platform.

In some embodiments, as shown in FIG. 2O, one or more cradle extensions 460 can be added to any of the bases or secondary housings described herein. The cradle extension can be configured with the same dimensions described above for the plate rack bases. In some embodiments, any combination of bases and secondary housings can be envisioned. For example, in some embodiments, plate rack bases may be added to each other in series.

Figure 2Q:
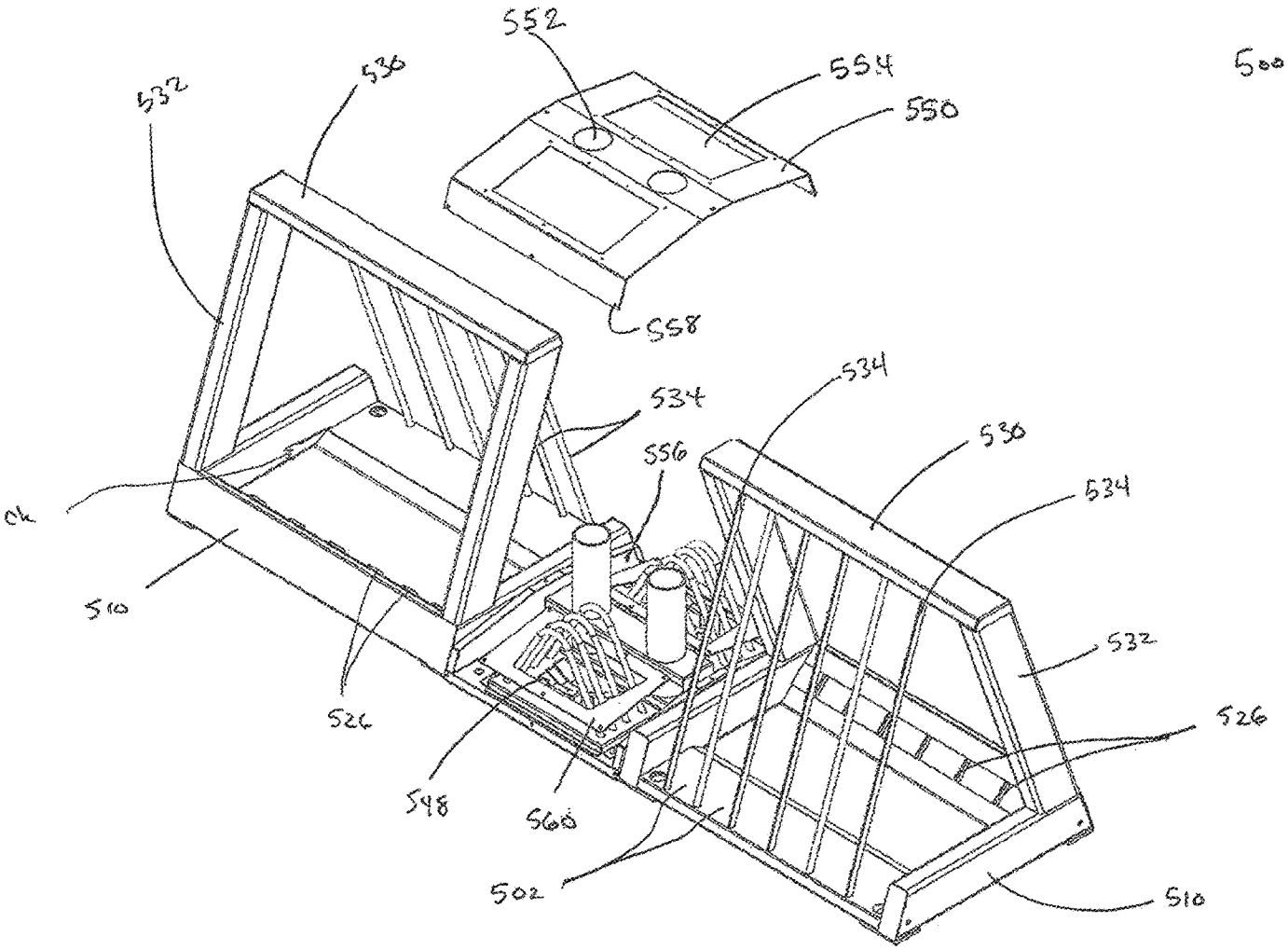

FIGS. 2P and 2Q show another embodiment of a plate rack 500. Each plate rack 500 can have any one or more of the above features or combinations of features used to describe plate rack 400. Therefore, it should be appreciated that, while the above disclosure at times discusses a plate rack 400, in embodiments of plate rack 500, any one above features and options can be included. The plate rack 500 may be identical or similar to the plate rack 400, discussed above in more detail, in many respects. Accordingly, numerals used to identify features of the plate rack 400 are incremented by a factor of 100 to identify like features of the plate rack 500. Conversely, the plate rack 400 may be identical or similar to the plate rack 500, discussed below in more detail, in many respects.

As shown in FIGS. 2P and 2Q, in some embodiments, the plate rack comprises two bases 510 and one secondary housing 540. In some embodiments, as described above, the plate rack 500 may comprise one or more bases 510 and a one or more secondary housings 540. As shown in FIGS. 2P and 2Q, the bases can face in opposite directions to accommodate lifters on adjacent platforms. As shown in FIGS. 2P and 2Q, in some embodiments, a plurality of weight disc holding portions can be provided to, again, accommodate lifters on adjacent platforms.

Figure 2R:
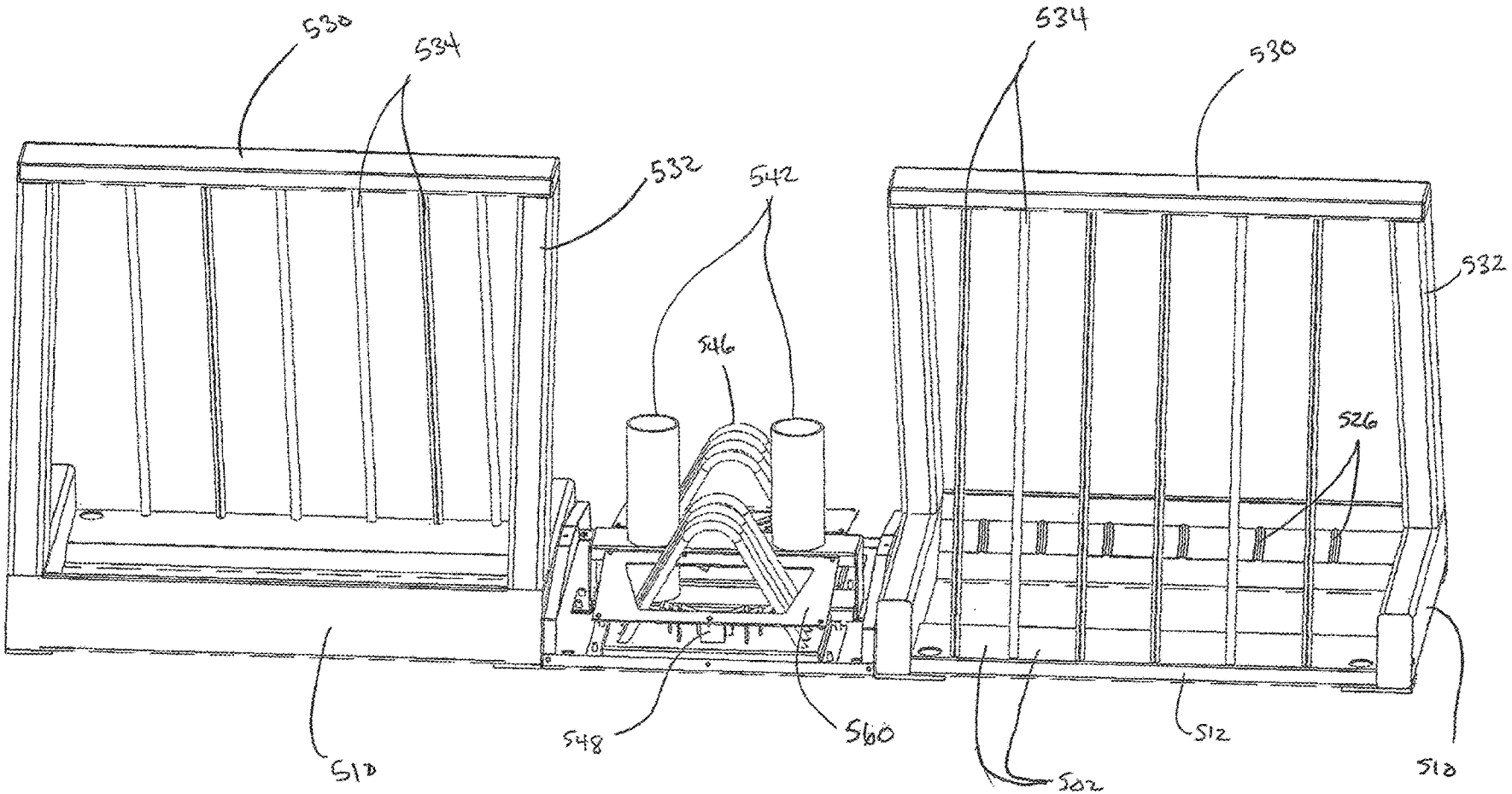
FIG. 2R is a perspective view of an embodiment of a plate rack.

In some embodiments, as shown in FIG. 2R, the secondary housing 540 further comprises a weight disc holding portion fortifying unit 560. This unit can provide added stability to the weight disc holding portion. In some embodiments, the fortifying unit 560 also is used to provide a seal between the weight disc holding portion and the removable housing cover. In some embodiments, the fortifying unit 560 is separate and modular because different brands of weights have different dimensions and therefore, require a different support system and corresponding cover opening.

As shown in FIGS. 2P and 2Q, in some embodiments, a seven slot plate rack base 510 is provided. As discussed above, and as shown with respect to plate rack 400, other numbers of plate slots may be provided in any embodiment of plate rack base.

Figure 2S:
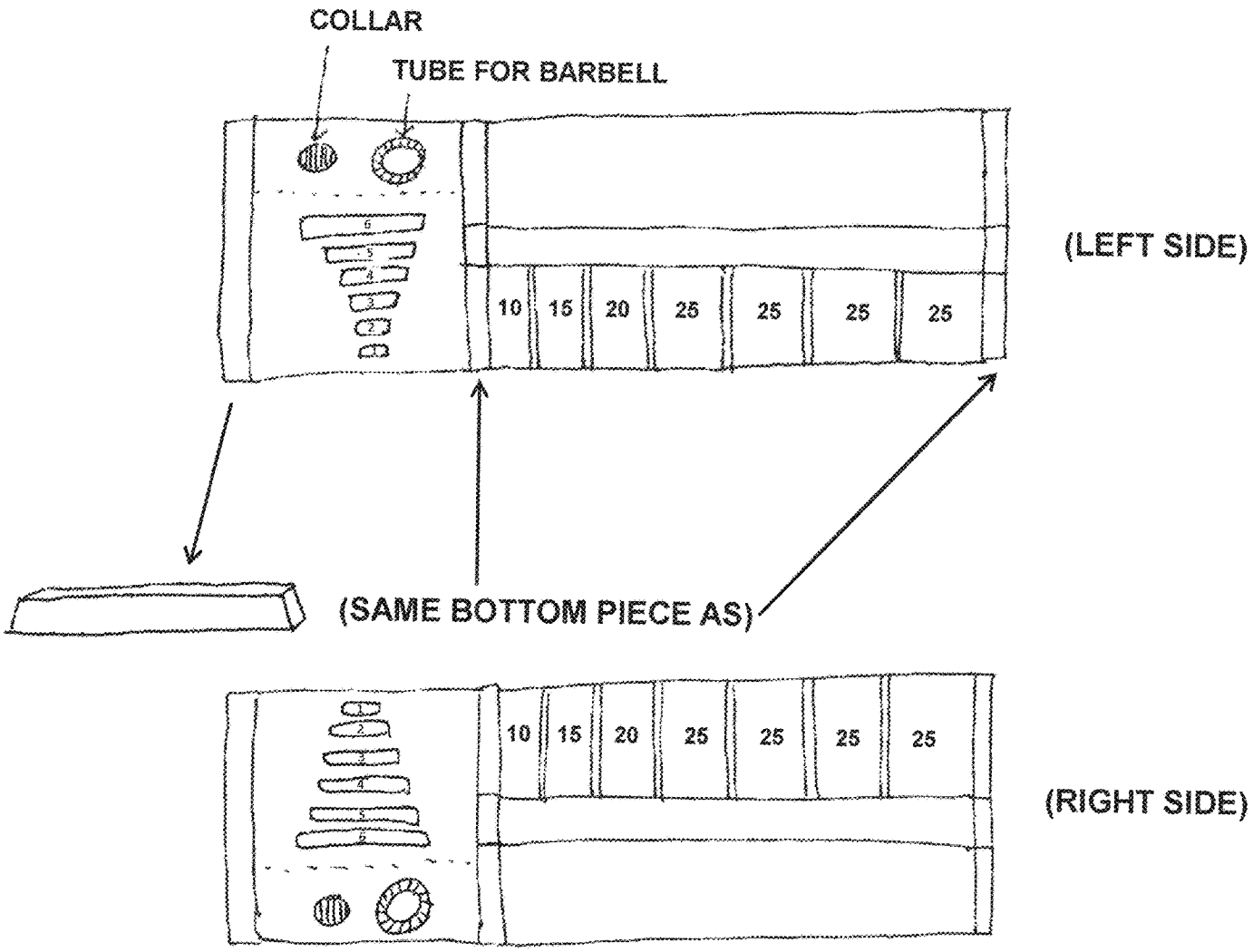
FIG. 2S shows a configuration of an embodiment of two plate racks.

FIG. 2S shows an embodiment of plate racks that can be used on a platform. In some embodiments, 1, 2, 3, 4, or more of the above described plate racks can be used to service a platform or adjacent platforms. For example, different sized matching plates, as enumerated in FIG. 2S, can be placed on opposite sides of a weight lifting platform. As the weight is increased, for instance, during a competition, weights can be pulled from both plate racks on either side of the platform. Those weights can then be quickly placed on the barbell for the next lifter (and the previous weights can just as easily and safely be removed).

In some embodiments, the plate rack comprises a material selected from the group consisting of titanium, iron, steel, aluminum, nylon, high-density polyethylene, polypropylene, polystyrene and combinations thereof. In some embodiments, the plate rack comprises steel. In some embodiments, the plate rack comprises 7 gauge steel tubing. In some embodiments, the plate rack comprises 11 gauge steel tubing.

Jerk Block

Some embodiments, provide an adjustable height weight block (e.g. jerk block) system (see, e.g., FIGS. 3A-3D). While a person is lifting weights, "jerk" blocks can be employed to provide an elevated platform on which to drop a loaded barbell. A jerk is a shoulder-to-overhead movement. During a jerk, a person holds a barbell in the "racked" position, such that the approximate center of the barbell rests on the upper chest/collarbone area of the torso and across the shoulders. Barbell weight plates straddle the weight lifter's body. A jerk is performed from this racked position by dipping the body (i.e., bending at the hip and knees) and forcefully "opening" the hip and knee joints (i.e., fully extending the hip and knee to a fully upright stance). After this forceful opening of the hip and knee joints, momentum is transferred from the lifter's body to the barbell which, at the maximum extension of the hips and knees, lifts from the shoulders. As the bar lifts from the body after full body extension and begins to elevate off the shoulders of the lifter, the lifter immediately dips his body under the bar (bending the knees and hips) such that the lifter can extend his or her arms upwardly and under the bar. As barbell reaches an apex point—a point of maximum elevation as the momentum of the barbell is lost to gravity—the lifter's arms come to full extension to catch the barbell. The lift is completed by the when the lifter then returns to the standing position with the barbell "locked-out" fully overhead (i.e. the elbows are fully extended with the barbell overhead). The weight can then be dropped back to the ground or to the shoulders. Other lifts that employ movements to move the bar from the shoulder to the locked-out position include shoulder presses, push jerks, etc.

During training, jerks and other shoulder-to-overhead movements are performed multiple times. If the lifter drops the bar to the ground each time he or she performs a jerk, extra energy is expended to lift the bar to the racked position. This leads to fatigue and the lifter may be unable to maximize the strength training he could take advantage of were the weight more easily brought to the racked position. Alternatively the lifter may attempt to guide the weight from the overhead position back down to the racked position. However, the weight is often heavier than a lifter can safely and easily control while eccentrically guiding the weight back to the racked position. This lack of control can lead to injuries. Jerk blocks provide an elevated platform so that the lifter can safely drop a loaded barbell without having to retrieve it from the ground. Using jerk blocks, the jerk (or some other movement where lifting from the ground to the rack position is not the focus of the movement) can become a focal point of training, as the jerk is the only portion of the lift that need be performed. Jerk blocks can also be used to focus on specific portions of the snatch or clean portions of Olympic lifts as well. The above examples of lifts are purely exemplary and the jerk blocks described herein are intended to provide an elevated platform for any barbell activity.

Jerk blocks typically consist of stackable, rectangular frames. Each stackable frame typically has a height, a length, and a width wherein the length is greater than the width, and the width is greater than the height. The assembled stack of rectangular wooden frames together forms a single jerk block. Two jerk blocks are employed during weight training. One jerk block is placed on either side of the lifter so that when the lifter drops a loaded barbell, the weight plates land on top of the jerk block. The topmost stackable frame of a jerk block comprises a surface that is configured to receive a dropped weight. The height of each jerk block can be adjusted by inserting additional jerk block sections to increase height or by removing them to decrease height. Thus, the increments of height adjustment are determined by the height of each stackable frame.

In order to accommodate the abuse tolled during the dropping of barbell weight, jerk blocks often comprise heavy wood or are themselves solid wood. These stackable sections are heavy and cumbersome to move, making adjustment of their height difficult. Injuries can also occur during the movement of these jerk block sections because of their weight and awkwardness. Fine adjustment of jerk block height is also limited to increments of height provided by the jerk block sections. An unmet need exists for jerk blocks that are easily adjustable, durable, and that have finely tunable heights.

Some embodiments disclosed herein provide an adjustable jerk block system that resolves the deficiencies of current jerk block systems. In some embodiments, the jerk block 600 comprises a table top 610 connected to a jerk block leg 620, wherein the jerk block leg 620 is further connected to a jerk block foot 602. In some embodiments, the jerk block system provides for fine height control. In some embodiments, the height can be adjusted and controlled by a user or users without substantial lifting effort by the user(s).

Figure 3A:
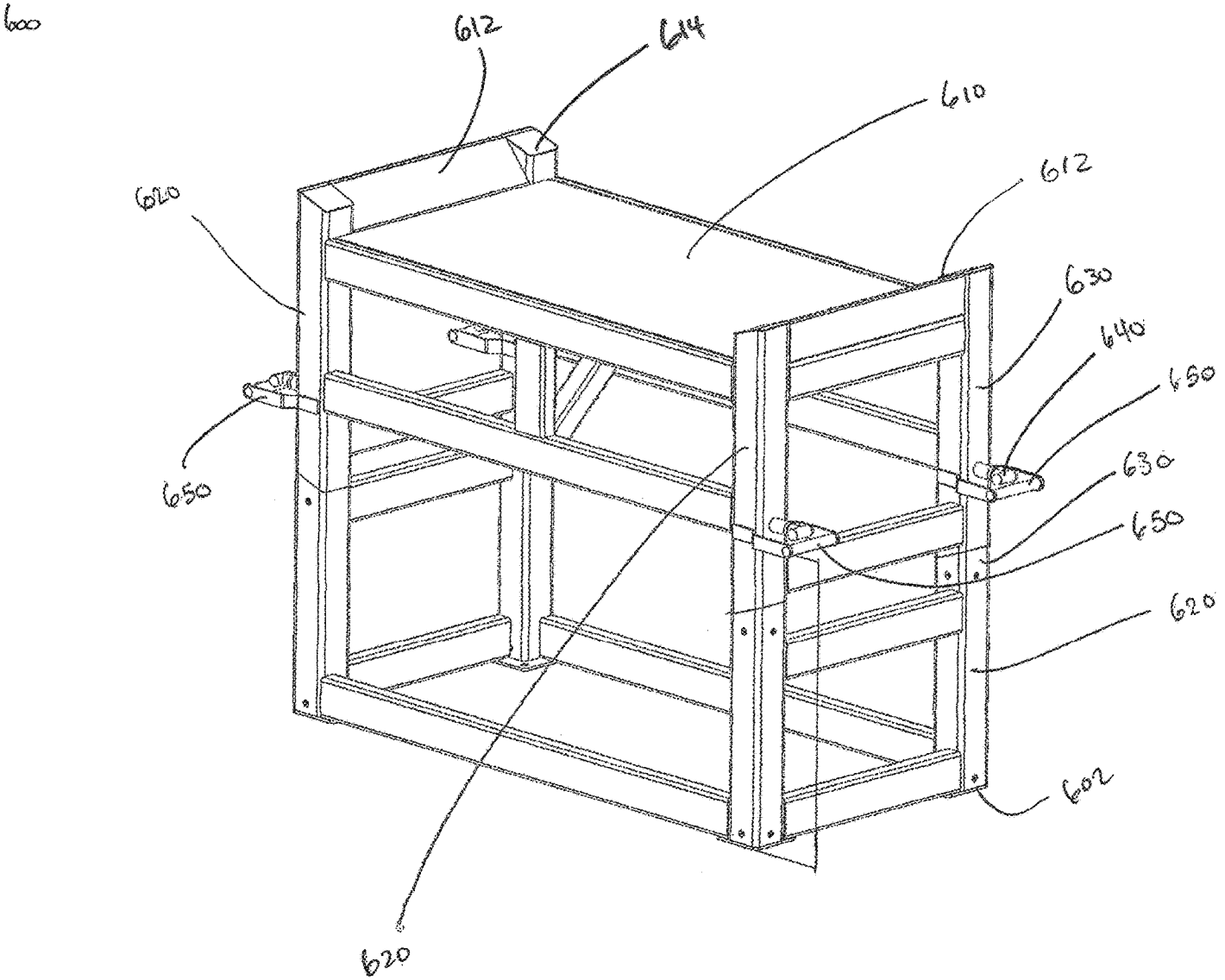
FIG. 3A is a perspective view of an embodiment of a jerk block.
Figure 38:
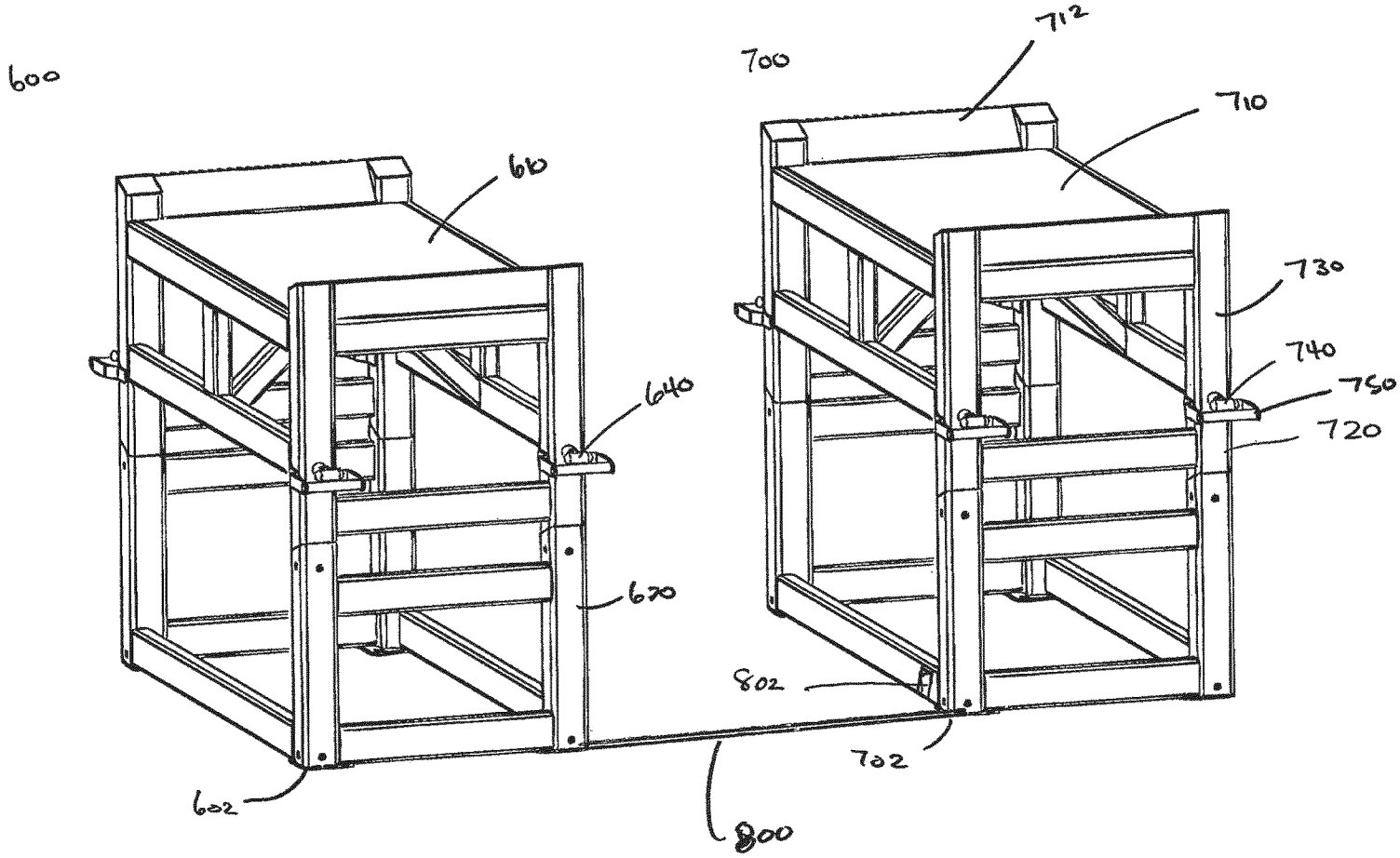

In some embodiments, the weight block system comprises a jerk block 600 as shown in FIG. 3A, or a plurality of jerk blocks (e.g. two or more jerk blocks; FIG. 3B shows a configuration with two jerk blocks 600, 700). The second jerk block 700 may be identical or similar to the first jerk block 600 discussed below in more detail in many respects. Accordingly, numerals used to identify features of the second jerk block 700 are incremented by a factor of 100 to identify like features of the first jerk block 600.

Figure 3C:
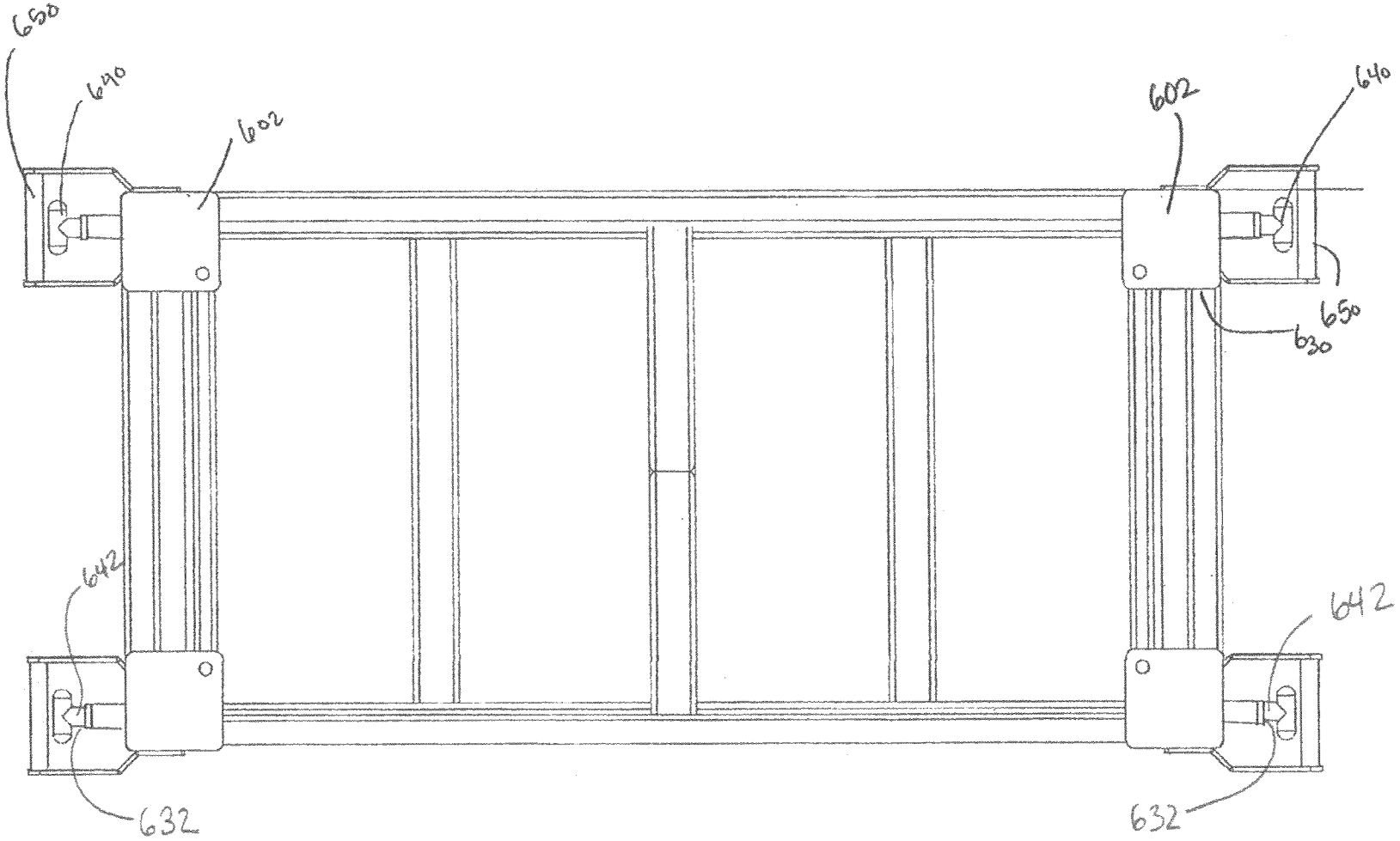
FIG. 3C is a bottom view of the jerk block of FIG. 3A.
Figure 3D:
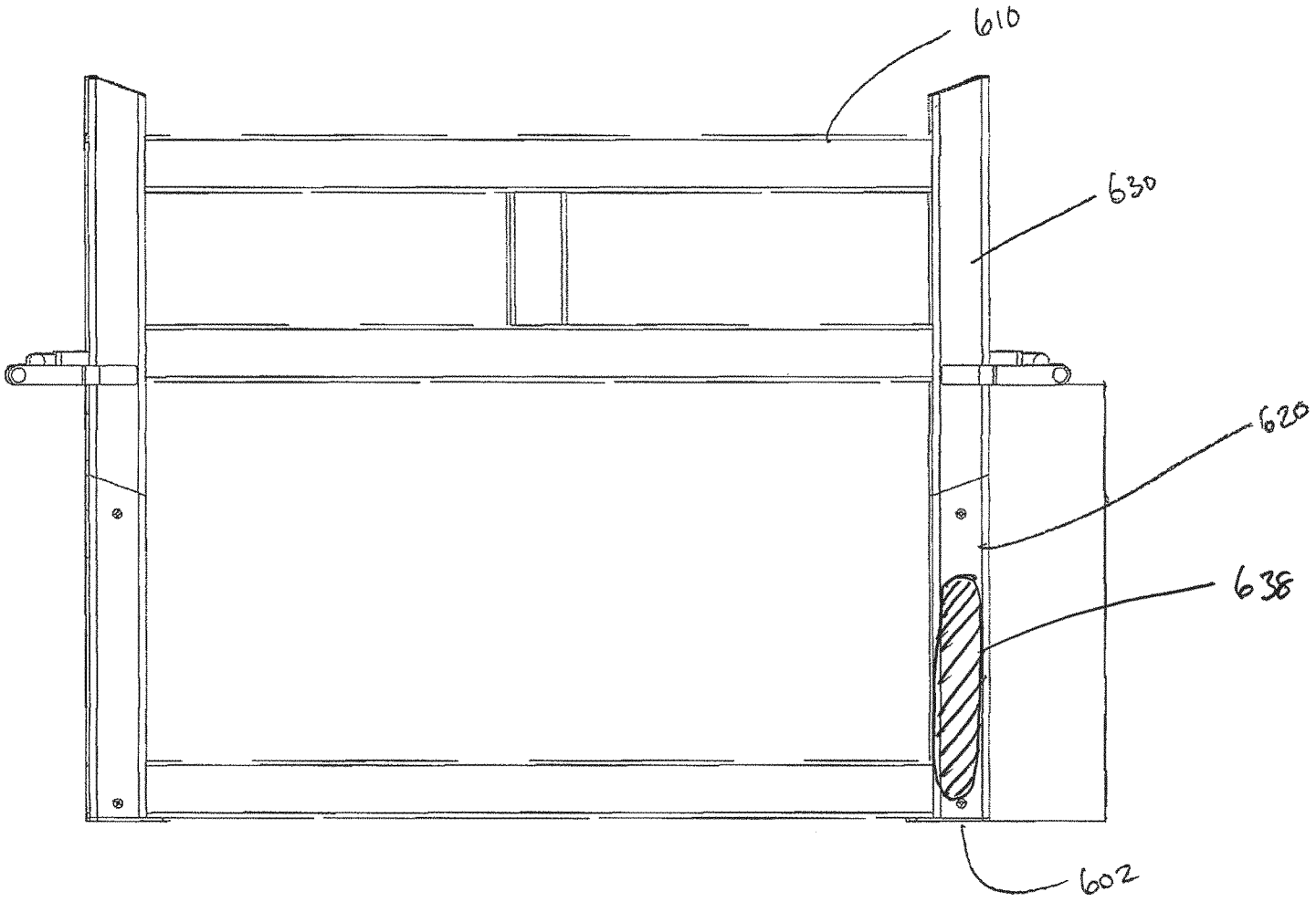
FIG. 3D is a side view of the jerk block of FIG. 3A.
Figure 3E:
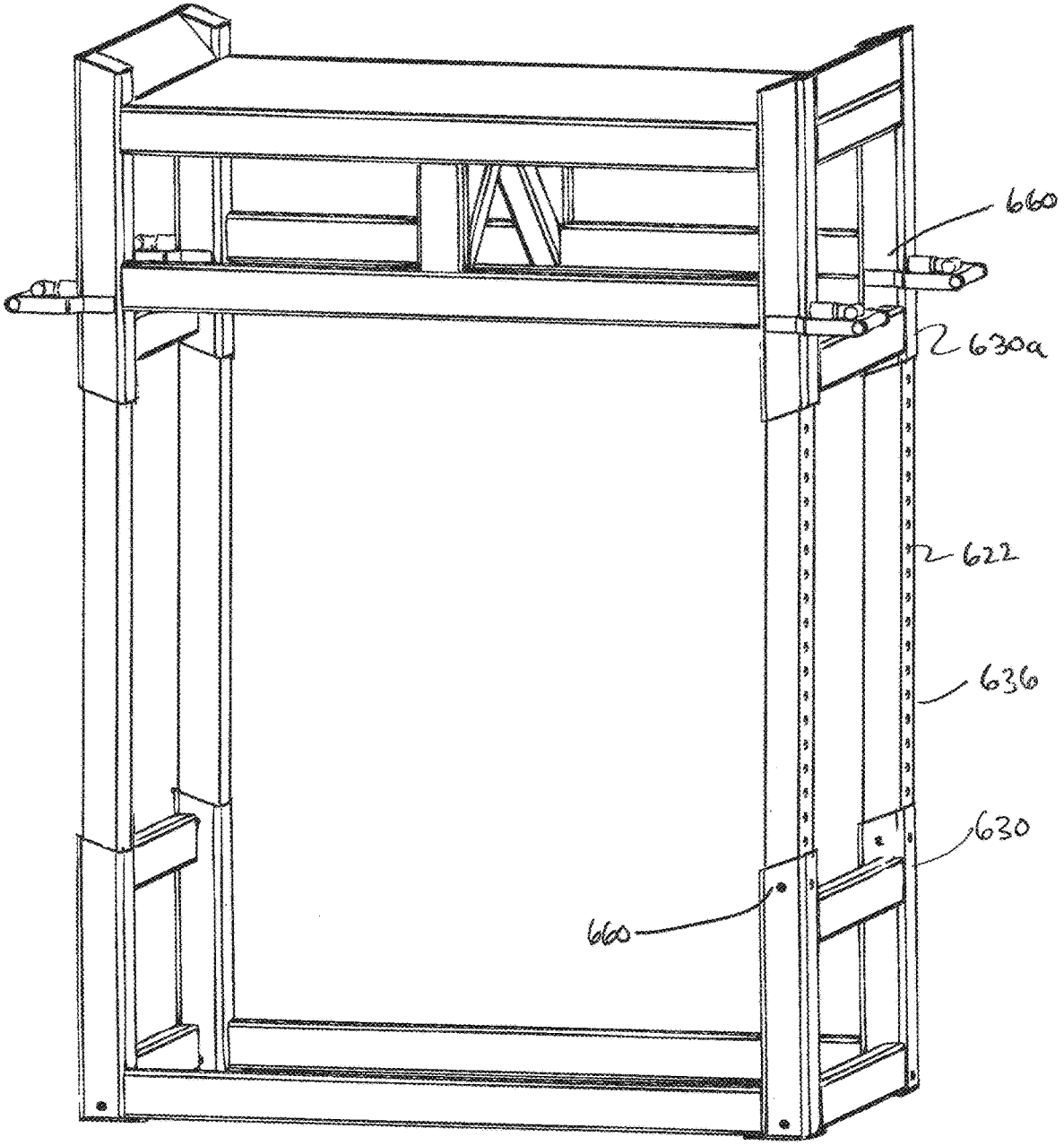
FIG. 3E is a perspective view of the jerk block of FIG. 3A with the height adjusted.

In some embodiments, as shown in FIG. 3E, the height of the jerk block 600 (e.g. as measured as the distance from the bottom of the jerk block foot 602 to the table top 610) can be adjusted. In some embodiments, the jerk block leg 620 comprises a male leg extension member 636/leg sheath 630 design. In some embodiments, as shown in FIGS. 3A-E, the table top 610 is attached (e.g. welded, bolted, glued, or otherwise affixed) to a leg sheath 630 and the extension member 636 is attached to the foot 602. In some embodiments, the table top is attached (e.g. welded, bolted, glued, or otherwise affixed) to an extension member and the sheath can be attached to the foot. In some embodiments, as shown in FIG. 3E, the male extension member 636 can be inserted into a first leg sheath 630 and a second leg sheath 630*a*. In some embodiments, the male extension member 636 may then be affixed to either the first or second leg sheath 630, 630*a* to allow the extension member to move into or out of the other leg sheath.

In some embodiments, as shown in FIG. 3A, the table top 610 comprises one or more table top ramps 612. The table top ramps 612 can be affixed (e.g., welded, bolted, etc.) into place or can be snapped into place on the table top 610. In some embodiments, the table top prevents a loaded barbell from rolling off of the jerk block 600. In some embodiments, the ramps 612 further serve to guide a dropped barbell onto the table top 610.

In some embodiments, as shown in FIG. 3A, the table top 610 further comprises one or more ridges 614 placed on either side of the ramp 612. In some embodiments, as shown in FIG. 3A, the table top 610 further comprises one or more lips 616 placed on either side of the table top 610. The ridges 614 and lips 616 can, together or separately, prevent a dropped barbell from bouncing sideways from the jerk block 600.

In some embodiments, when the table top 610 is attached to the a leg sheath 630, the table top 610 can be extended upwardly off of a male leg extension member 636 such that the male leg extension member 636 exits out of the leg sheath 630, thereby increasing the height of the jerk block 600 table top 610. A securing member can then be inserted through the leg sheath 630 and male extension member 636 via a leg sheath aperture 632 and a corresponding extension member aperture 622. In some embodiments, the extension member has apertures aligned substantially vertically along it. In some embodiments, the extension member has 1, 2, 3, 4, 5, 6, 7, 8, 9, 10, or more apertures configured to receive a securing member. In some embodiments, the leg is telescopic and without a extension member to allowing the leg to collapse and expand to any desired height.

In some embodiments, the securing member 642 (e.g. a pin, a bolt, a clip, a screw, a rod, etc.) is configured to engage the leg sheath 630 and/or the male extension member 636 simultaneously. In some embodiments, when the leg sheath 630 and/or male extension 636 member are engaged by the securing member 642, the table top 610 is maintained at a height above the surface below the jerk block 600. In some embodiments, the securing member 642 comprises a handle 650 (e.g. a grip).

In some embodiments, when the securing member 642 is inserted through the apertures of the male leg extension member 636 and the leg sheath 630, the securing member 642 secures the table top 610 at a preselected height. In some embodiments, the male leg extension member 636 has a series of extension member apertures 622 configured to be engaged by the securing member 642. These apertures allow several preselected heights to be selected for the jerk block.

In some embodiments, the extension member apertures 622 are about 2 inches apart so that the table top 610 can be raised or lowered via the male leg extension member 636 at about 2 inch increments. In some embodiments, to allow adjustment of the jerk block height, the extension member apertures are separated by a distance of about 0.5 inches, 1 inch, about 2 inches, 3 about inches, values in between, above, or below the aforementioned values, and otherwise.

In some embodiments, the jerk block 600 table top 610 can be adjusted to heights (e.g., over the surface below the jerk block) of 3", 6", 1', 2', 3', 4', 5', 6', 7', or more as well as heights in between the aforementioned values, and otherwise.

In some embodiments, the securing member comprises a pop pin design wherein the pop pin 640 is spring loaded. In the pop pin design, the securing member may be physically mounted (e.g. welded or screwed into place) to the leg sheath 630. In some embodiments, release of the pop pin 640 securing member allows the securing member to recoil through a sheath aperture 632 and into a corresponding male leg extension member aperture 622. For example, the pop pin 640 can be pulled out to allow movement of the leg sheath 630 upwardly and downwardly around the male leg extension member 636. Once an appropriate height is selected for the jerk block 600, the pop pin 640 can be released to engage the leg sheath aperture 632 and male leg extension member 636 via the extension member aperture 632 simultaneously.

In some embodiments, a pop pin 640 is used to lock the table top 610 into position. In some embodiments, the pop pin design aids in the raising and lowering of the table. The user is able to simultaneously grip the handle and release the pop pin to raise the table top (instead of one hand holding the handle and the other pulling the pop pin the design). The pop pin/handle combo requires fewer hands to lift and engage the pin. The handles can either be fabricated in a vertical, horizontal, or diagonal position. In some embodiments, as shown in FIGS. 3A-D, four handles 650 and pop-pins 640 can be used. This configuration requires two users (one on either side of the jerk block) to adjust the height of the jerk block. Each user can grasp two handles 650 and release the pop-pin 640 to adjust the height of the block.

Other configurations are envisioned. For instance, in some embodiments, one or two handles and pop-pins can be employed such that one user can adjust the height of the jerk block by him or herself. In some embodiments, the jerk block can have 1, 2, 3, 4, 5, or more handles and pop-pins per jerk block.

In some embodiments, the handles can be located at the end of the jerk block 600 (as shown in FIGS. 3A-3D) while in other embodiments, the handles and pop-pins can be located on the side of each jerk block (instead of at the ends). In some embodiments, both side- and end-mounted handles can be employed on a single jerk block. In some embodiments handles 650 are provided on each side of the jerk block 600. These handles can be ergonomic or otherwise and can be used to facilitate raising or lowering the jerk block 600 table top 610

In some embodiments, the handles 650 are staggered from the pop pin (above or below the pop pin). The staggered design is more ergonomically-friendly. In some embodiments, when one grasps the handles to lift the table top 610, the "natural" position where the pop pin 640 would sit on the fingers to be pulled is not in line with the handle 650 and therefore a staggered design may be employed. In some embodiments, the handle 650 is at a greater distance from the leg 620 than the pop pin 640. In some embodiments, this spacing allows the palm of a user's hand to reside under the handle 650 while the user's fingers remain free to engage and operate the pop pin 640.

In some embodiments, the jerk block 600 features a lift assisted system (magnetic, hydraulic, electric, etc.) for raising the table top 610. In some embodiments, a gas-assisted cylinder design 638, as shown in FIG. 3D, can be used to facilitate raising of the table top 610. In some embodiments, the gas cylinders assist the user so that the user does not need to lift the full weight of the table top. Other lift assists can also be used such as, pulley system, gears, counter-balance weight, and friction system is being looked into. In some embodiments, the jerk block 600 does not feature assisted lifting.

In some embodiments, as shown in FIG. 3E, the jerk block features a safety lock 660 that automatically engages when a barbell rests on the jerk block 600. In some embodiments, the safety lock 660 prevents the pop pin from disengaging. Thus, the safety lock 660 prevents adjustment of the jerk block 600 when a weight is on top of the jerk block 600. This height locking system helps prevent injury to users.

In some embodiments, the foot 602 is configured with holes or with bolts such that the jerk block can be affixed to an Olympic weightlifting platform. This configuration allows additional stability of the jerk block system.

In some embodiments, the leg further comprises rolling elements (e.g., wheels) that can be engaged or disengaged to allow free movement of the jerk block from or to a weight lifting platform (for example, when the jerk block is not affixed to a lifting platform). In some embodiments, the wheels can be engaged or disengaged by cinching the wheel using a wheel handle or using a foot peddle that is connected to the wheels and to a foot. In some embodiments, the wheels can be engaged by twisting the handles 650.

In some embodiments, the wheels can be engaged by tilting the jerk block 600 such that rolling elements engage the platform. This design is similar to that of the weight stand 200 and can have one or more features in common with the weight stand rolling element design.

In some embodiments, as shown in FIG. 3C, the foot 602 comprises an alignment aperture 604 (e.g. an aperture or window) through the foot 602 which allows a portion of the platform below the foot 602 to be visible when the jerk block 600 is in position. This alignment window can be used to assist a weightlifter in positioning the jerk block 600 on, for example, an Olympic lifting platform. For instance, because in some embodiments the first jerk block 600 and the second jerk block 700 are independently positionable on a weight lifting platform, improper positioning of the jerk blocks 600, 700 can leave the jerk blocks 600, 700 spaced too closely or too far apart to hold a barbell properly and safely. The alignment window can be used to allow better positioning of the jerk blocks 600, 700. The weight platform can be marked with position indicators such that when the alignment apertures of jerk blocks 600, 700 are aligned with the jerk blocks' respective position indicators, the first jerk block and the second block are at a proper distance from one another.

In some embodiments, when two jerk blocks are present, as shown in FIG. 3B, a spacer element 800 can be used to correctly distance the jerk blocks from one another. In some embodiments, the spacer unit is a metal strip that connects the leg of one jerk block to the leg of a different jerk block. In some embodiments, the spacer element is low profile so that it can be stepped on by a user without disrupting the user's lift.

In some embodiments, as shown in FIG. 3B, the jerk block comprises a measuring tool 802 (e.g., a tape measure, measuring strip, a ruler, etc.) that can be deployed from a jerk block to determine its distance from another jerk block.

In some embodiments, the jerk block comprises a material selected from the group consisting of titanium, iron, steel, aluminum, nylon, high-density polyethylene, polypropylene, polystyrene and combinations thereof. In some embodiments, the jerk block comprises steel. In some embodiments, the jerk block comprises 7 gauge steel tubing. In some embodiments, the jerk block comprises 11 gauge steel tubing.

An integrated weight rack can also be inserted into the base of the jerk table. In the same modular manner that all the other pieces described above (e.g., weight stands, plate racks, jerk blocks), in some embodiments the base section of the jerk block can also be swapped out with a taller base sections or shorter base sections.

Although weight racks, plate racks, and jerk blocks have been disclosed in the context of certain embodiments and examples, it will be understood by those skilled in the art that the weight racks, plate racks, and jerk blocks beyond the specifically disclosed embodiments to other alternative embodiments and/or uses of the embodiments and certain modifications and equivalents thereof. It should be understood that various features and aspects of the disclosed embodiments can be combined with or substituted for one another in order to form varying modes of the weight racks, plate racks, and jerk blocks. Furthermore, fully integrated system that connects one or more of the weight racks, plate racks and jerk blocks is envisioned. In some embodiments, a floor frame is provided that allows the weight racks, plate racks and jerk blocks to be placed in appropriate positions for appropriate exercises.

As used herein, the terms "approximately," "about," and "substantially" as used herein represent an amount close to the stated amount that still performs a desired function or achieves a desired result. The terms "approximately," "about," and "substantially" are meant to encompass, for example, values that are within 0.5%, 1.0%, 2.0%, 3.0%, 4.0%, 5.0%, 7.5%, 10.0% relative to the value modified by those terms. For instance "about 30%," where "about" represents 10% variability, is equivalent to a value of "30%±3%"). In some instances, the terms "approximately,"

"about," and "substantially" may represent variability that is more than 10.0% away from the value modified by those terms.

Any portion of any of the steps, processes, structures, and/or devices disclosed or illustrated in one embodiment, flowchart, or example in this disclosure can be combined or used with (or instead of) any other portion of any of the steps, processes, structures, and/or devices disclosed or illustrated in a different embodiment, flowchart, or example. The embodiments and examples described herein are not intended to be discrete and separate from each other. Combinations, variations, and other implementations of the disclosed features are within the scope of this disclosure.

Terms relating to circular shapes as used herein, such as diameter or radius, should be understood not to require perfect circular structures, but rather should be applied to any suitable structure with a cross-sectional region that can be measured from side-to-side. Terms relating to shapes, such as "circular" or "cylindrical" or "semi-circular" or "semi-cylindrical" or any related or similar terms, are not required to conform strictly to the mathematical definitions of circles or cylinders or other structures, but can encompass structures that are reasonably close approximations. Likewise, shapes modified by the word "generally" (e.g., "generally rectangular") can include reasonably close approximations of the stated shape.

Some embodiments have been described in connection with the accompanying drawings. The figures are drawn to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Additionally, the operations may be rearranged or reordered in other implementations. Also, the separation of various system components in the implementations described above should not be understood as requiring such separation in all implementations, and it should be understood that the described components and systems can generally be integrated together in a single product or packaged into multiple products. Additionally, other implementations are within the scope of this disclosure.

Conditional language used herein, such as, among others, "can," "could," "might," "may," "e.g.," and the like, unless specifically stated otherwise or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Further, while illustrative embodiments have been described, any embodiments having equivalent elements, modifications, omissions, and/or combinations are also within the scope of this disclosure. Moreover, although certain aspects, advantages, and novel features are described herein, not necessarily all such advantages may be achieved in accordance with any particular embodiment. For example, some embodiments within the scope of this disclosure achieve one advantage, or a group of advantages, as taught herein without necessarily achieving other advantages taught or suggested herein. Further, some embodiments may achieve different advantages than those taught or suggested herein.

EXAMPLES

Example 1

The squat rack is a unique five-piece design that allows the rack to be used either as a standard squat rack or as two independent squat stands. The sturdy, stable frame is made from 7 and 11 gauge steel tubing. It can easily support the heaviest of training weights. Specifically designed wheel system and handle makes moving these heavy duty squat stands easy. The fender cover over the wheels assists in tilting the stand to engage the wheels. The high-impact resistant polyethylene guards on the bar holders help to protect the knurling of the barbell from use and wear. The design features adjustable vertical tube that is zinc-plated for maximum durability; pop pin assembly with easy grip pull pin; capable of handling the heaviest of loads; adjustable bar hooks in 12 different positions at 2 inch increments from 43 inches to 65 inches with a simple pull on the pop pin; unique five piece design; removable center bar that turns the squat stand into a pair of uprights; wear guards to protect the knurling of barbells; and an angled base on each uprights increases the stability of the squat stand and provides a large entry space to unrack and rack a weighted barbell. The design is space efficient and mobile. It is great for multi-use rooms and training facilities with Infinity Flooring™.

The above-disclosed subject matter is to be considered illustrative, and not restrictive or exclusive of other modifications, enhancements, and embodiments that fall within the true spirit and scope of the present disclosed subject matter.

Example 2

Embodiments of the plate rack provide a design that can customize the way an individual trains for fitness, health, and other athletic activities such as competitions. The modular racking system allows an individual to select from a variety of options to meet individual training and competition needs. Using a minimum amount of floor space, this storage system provides maximum efficiency in weight and barbell storage. The design features include a unique roll-in, roll-out design. The low profile front edge allows for removing and replacing weight plates with ease without having to lift them out. It also functions as a unique modular storage unit: 1) you can change out the bumper plate section for a larger one, 2) add on an extension piece, 3) turn the bumper plates on to "feed" adjacent platforms, 4) attach both bumper plate sections in the same direction, or 5) set them up in any other configuration that best meets an individual's needs. The removable small weight holder can be swapped out to difference sized weight discs of the same weight. There is a lockable weight racking system with specifically designed slots to house the different sizes of weight plates for the ability to easily lock and secure the weights. The uniquely angled weight cradle system for both bumper plates (and, for example metal plates) is specifically designed to house designed weight plates. This cradle system also aligns all holes on weights to easily secure and lock equipment in place when not in use, or to prevent access by young children when proper adult supervision is not present. The space efficient design is compact and the anchor holes are either recessed or hidden. Rubber bumpers on storage pegs were designed to protect frame finish from competition collar. Hemispherical rubber end caps on competition collar pegs assist loading and dampen noise. The design is sleek and minimal and customizable to meet an individual's current and future training needs.

The following models demonstrate variations of the plate rack:

| Models; | | | | | |
|---|---|---|---|---|---|
| 201-078T | 201-157T | 201-153T | 201-307T | 201-157C | 201-025T |
| Single 4-Slot Holds two Olympic bars | Double 4-Slot Holds two Olympic bars | Single 7-Slot Holds two Olympic bars | Double 7-Slot Holds two Olympic bars | Single 7-Slot Holds one Olympic bar Holds one competition collar | Single Extension Holds one 25 kg. Bumper Plate |
| 1-25 kg. Bumper | 2-25 kg. Bumper | 4-25 kg. Bumper | 8-25 kg. Bumper | 4-25 kg. Bumper | |
| 1-20 kg. Bumper | 2-20 kg. Bumper | 1-20 kg. Bumper | 2-20 kg. Bumper | 1-20 kg. Bumper | |
| 1-15 kg. Bumper | 2-15 kg. Bumper | 1-15 kg. Bumper | 2-15 kg. Bumper | 1-15 kg. Bumper | |
| 1-10 kg. Bumper | 2-10 kg. Bumper | 1-10 kg. Bumper | 2-10 kg. Bumper | 1-10 kg. Bumper | |
| 1-5.0 kg. Disc | 2-5.0 kg. Disc | 1-5.0 kg. Disc | 2-5.0 kg. Disc | 1-5.0 kg. Disc | |
| 1-2.5 kg. Disc | 2-2.5 kg. Disc | 1-2.5 kg. Disc | 2-2.5 kg. Disc | 1-2.5 kg. Disc | |
| 1-1.25 kg. Disc | 2-1.25 kg. Disc | 1-1.25 kg. Disc | 2-1.25 kg. Disc | 1-2.0 kg. Disc | |
| | | | | 1-1.5 kg. Disc | |
| | | | | 1-1.0 kg. Disc | |
| | | | | 1-0.5 kg. Disc | |

Example 3

This jerk block features a first-of-its-kind, lift assisted system for raising the table top. The current prototype uses a gas-assisted cylinder design. The gas cylinders are like the ones used for hatchbacks or mini vans.

Other means of "lift-assist" can also be used such as, pulley system, gears, counter-balance weight, friction and magnetic system are envisioned.

Ergonomic handle and pop pin design aid in the raising and lowering of the table; Instead of one hand holding the handle and the other pulling the pop pin. The pop pin/handle combo require less hands to lift and engage the pin. The handles can either be fabricated in a vertical, horizontal, or diagonal position.

The handles are also staggered from the pop pin. The staggered design is more ergonomically-friendly. When you grasp the handles to lift the top, the "natural" position where the pop pin would sit on the fingers to be pulled is not in line with the handle and therefore a staggered design was selected.

An integrated weight rack can also be inserted into the base of the jerk table.

In the same modular manner that all other pieces of equipment in the line, the base section can also be swapped out with a taller base section, so that the jerk blocks would have the same 10" adjustability, however the bottom position will be higher.

Although weight racks, plate racks, and jerk blocks have been disclosed in the context of certain embodiments and examples, it will be understood by those skilled in the art that the weight racks, plate racks, and jerk blocks beyond the specifically disclosed embodiments to other alternative embodiments and/or uses of the embodiments and certain modifications and equivalents thereof. It should be understood that various features and aspects of the disclosed embodiments can be combined with or substituted for one another in order to form varying modes of the weight racks, plate racks, and jerk blocks. Thus, it is intended that the scope of the present invention herein disclosed should not be limited by the particular disclosed embodiments described above, but should be determined only by a fair reading of the claims that follow.

Similarly, this method of disclosure, is not to be interpreted as reflecting an intention that any claim require more features than are expressly recited in that claim. Rather, as the following claims reflect, inventive aspects lie in a combination of fewer than all features of any single foregoing disclosed embodiment. Thus, the claims following the Detailed Description are hereby expressly incorporated into this Detailed Description, with each claim standing on its own as a separate embodiment.

What is claimed is:

1. An adjustable jerk block comprising:

a table top;

a leg connected to the table top, wherein the leg is configured to hold the table top a distance from a floor, the leg comprising:

a gas-assisted cylinder located within the leg and configured to facilitate raising of the table top through extension of the leg;

a leg sheath comprising a leg sheath aperture;

a male leg extension member comprising a plurality of male leg extension member apertures; and a securing member configured to engage the leg sheath and the male leg member via a male leg extension member aperture to hold the table top at a preselected height; and a foot member connected to the leg and configured to provide traction between the jerk block and the floor.

2. The jerk block of claim 1, wherein the securing member is affixed to the leg sheath and further comprises a spring-loaded pop-pin that automatically engages the leg sheath aperture and one of the male extension member apertures.

3. The jerk of claim 2, wherein the leg sheath further comprises a handle positioned in proximity to the pop-pin such that a single hand from a user can simultaneously grasp the handle and release the pop-pin.

4. The jerk block of claim 1, wherein the male leg extension member apertures are arranged substantially vertically along the male extension member.

5. The jerk block of claim 4, wherein the male leg extension member apertures are arranged at a distance of 2 inches from one another.

6. The jerk block of claim 1, wherein the jerk block further comprises a disengageable rolling element that allows free movement of the jerk block along the floor when in an engaged position and which does not allow free movement of the jerk block when in the disengaged position.

7. The jerk block of claim 1, wherein the foot member further comprises an alignment aperture configured to allow a portion of the floor below the foot to be visible and to allow proper positioning of the jerk block on the floor.

8. The jerk block of claim 1, wherein the jerk block further comprises a measuring tool deployable from the jerk block, wherein the measuring tool allows the distance between the jerk block and a second jerk block to be measured.

* * * * *